US008286569B2

(12) United States Patent
Nishiyama et al.

(10) Patent No.: US 8,286,569 B2
(45) Date of Patent: Oct. 16, 2012

(54) SEWING MACHINE

(75) Inventors: Shinji Nishiyama, Ichinomiya (JP); Akimitsu Kamatsuka, Kariya (JP)

(73) Assignee: Aisin Seiki Kabushiki Kaisha, Aichi (JP)

( * ) Notice: Subject to any disclaimer, the term of this patent is extended or adjusted under 35 U.S.C. 154(b) by 0 days.

(21) Appl. No.: 13/256,534

(22) PCT Filed: Mar. 1, 2010

(86) PCT No.: PCT/JP2010/001367

§ 371 (c)(1),
(2), (4) Date: Sep. 14, 2011

(87) PCT Pub. No.: WO2010/109773

PCT Pub. Date: Sep. 30, 2010

(65) Prior Publication Data

US 2012/0006241 A1 Jan. 12, 2012

(30) Foreign Application Priority Data

Mar. 25, 2009 (JP) ..... 2009-074116
Sep. 30, 2009 (JP) ..... 2009-227167

(51) Int. Cl.
*D05B 19/00* (2006.01)

(52) U.S. Cl. ..... 112/470.01; 112/273

(58) Field of Classification Search ..... 112/470.01, 112/470.03, 470.04, 470.05, 305, 102.5, 112/271, 272, 273, 274, 275, 277; 700/136, 700/137, 138

See application file for complete search history.

(56) References Cited

U.S. PATENT DOCUMENTS

| | | | | |
|---|---|---|---|---|
| 4,236,469 | A | 12/1980 | Takenoya et al. | |
| 4,289,084 | A | 9/1981 | Takenoya et al. | |
| 4,299,182 | A * | 11/1981 | Tanaka | 112/277 |
| 4,393,795 | A | 7/1983 | Makabe et al. | |
| 4,393,796 | A * | 7/1983 | Dunn et al. | 112/445 |
| 4,401,042 | A | 8/1983 | Hanyu et al. | |
| 4,485,750 | A | 12/1984 | Makabe et al. | |
| 4,501,210 | A | 2/1985 | Hanyu et al. | |
| 6,055,920 | A | 5/2000 | Hori | |
| 6,138,594 | A * | 10/2000 | Kito | 112/470.01 |
| 6,237,515 | B1 | 5/2001 | Nöltge | |

(Continued)

FOREIGN PATENT DOCUMENTS

DE 199 51 127 A1 5/2001

(Continued)

OTHER PUBLICATIONS

International Search Report for PCT/JP2010/001367 dated Mar. 23, 2010.

(Continued)

*Primary Examiner* — Danny Worrell
(74) *Attorney, Agent, or Firm* — Sughrue Mion, PLLC

(57) ABSTRACT

A low cost and easy-to-use sewing machine is provided which is capable of performing free motion sewing. The sewing machine includes a needle bar to which a needle can be mounted, a needle bar vertical moving mechanism, a needle bar swing mechanism causing the needle bar to swing in a lateral direction relative to a longitudinal direction along which a feed dog operates for straight stitch, and a control portion for adjusting a swing amount of the needle bar which is brought into swing movement in the lateral direction by the needle bar swing mechanism.

9 Claims, 16 Drawing Sheets

U.S. PATENT DOCUMENTS

| | | | |
|---|---|---|---|
| 7,007,619 | B2 | 3/2006 | Hamajima |
| 2007/0204781 | A1 | 9/2007 | Noguchi |
| 2009/0007829 | A1 | 1/2009 | Shimizu et al. |

FOREIGN PATENT DOCUMENTS

| | | | |
|---|---|---|---|
| DE | 100 63 002 | A1 | 8/2001 |
| DE | 101 61 264 | A1 | 8/2002 |
| JP | 55-71186 | A | 5/1980 |
| JP | 57-16537 | Y2 | 4/1982 |
| JP | 58-36998 | B2 | 8/1983 |
| JP | 59-31355 | B2 | 8/1984 |
| JP | 61-28355 | B2 | 6/1986 |
| JP | 61-28356 | B2 | 6/1986 |
| JP | 61-28357 | B2 | 6/1986 |
| JP | 61-50633 | B2 | 11/1986 |
| JP | 63-40112 | B2 | 8/1988 |
| JP | 63-59350 | B2 | 11/1988 |
| JP | 6-11678 | U | 2/1994 |
| JP | 7-39774 | U | 7/1995 |
| JP | 10-135629 | A | 5/1998 |
| JP | 2000-153088 | A | 6/2000 |
| JP | 2006-34675 | A | 2/2006 |
| JP | 2007-229291 | A | 9/2007 |
| JP | 2009-11478 | A | 1/2009 |

OTHER PUBLICATIONS

Extended European Search Report, dated Jul. 31, 2012, issued in European Application No. 10755580.7.

* cited by examiner

SEWING MACHINE

CROSS REFERENCE TO RELATED APPLICATIONS

This application is a National Stage of International Application No. PCT/JP2010/001367 filed on Mar. 1, 2010, which claims priority from Japanese Patent Application Nos. 2009-074116, filed on Mar. 25, 2009 and 2009-227167, filed on Sep. 30, 2009, the contents of all of which are incorporated herein by reference in their entirety.

TECHNICAL FIELD

The present invention relates to a sewing machine which can adjust an amount of swing movement of needle bar.

BACKGROUND ART

Conventionally, a sewing machine is known that can adjust amplitude of swing movement of a needle bar by switching operation when a sewing operation is at rest. This sewing machine has a bed portion, a column leg portion erecting from a right end of the bed potion, and an arm extending in a leftward direction to be in opposing to the bed portion. The bed portion is equipped with a feed dog for feeding a cloth, the needle bar to which a needle can be mounted at a head of the arm portion, a start and stop switch for ordering of starting and stopping the sewing operation, and a display showing various types of utility patterns or a variety of embroidery patterns, function names and more. In addition, an electronic sewing machine is disclosed in which the right side of the column leg portion is equipped with a connector jack to which a connecting cord plug of a foot controller is connected (refer to, for example, Patent Document 1). This sewing machine can change the amplitude amount of swing movement of the needle bar by user's switching operation when the user stops the sewing operation. Furthermore, this sewing machine comprises a foot controller having a variable resistor. User's by-foot depression of the foot controller is capable of ordering a microcomputer to start the sewing operation. Depending on an amount of the depression of the foot controller, a sewing speed is adjusted which is indicated by an elevating speed of the needle.

In addition, a sewing machine which includes a sewing machine motor, a speed control drive controlling the sewing machine motor, a speed command unit (foot controller) supplying a speed command signal to the speed control part, and more is disclosed (refer to, for example, Patent Document 2). When a user depresses a pedal of the speed command unit, a resistive value of a variable resistor changes which is provided in the pedal. And the speed command unit receives a speed command voltage, as the speed command signal, which depends on the resistive value and performing a driving control of the sewing machine in depending on the speed command voltage.

1: Patent Document 1: Japanese Unexamined Patent Publication No. 2006-34675

2: Patent Document 2: Japanese Unexamined Patent Publication Sho55-71186

DISCLOSURE OF THE INVENTION

Problem to be Solved by the Invention

Many household sewing machines are commercially available which are capable of sewing satin stitch embroidery.

However in such sewing machines, a user is compelled to feed a cloth in both a longitudinal direction (Y direction) along which a feed dog feeds the cloth during straight stitch and a lateral direction (X direction) traversing the longitudinal direction. For this reason, the sewing machines have to be equipped with an XY drive mechanism unit which can move a frame to which the cloth is fixed in both of the X and Y directions. Otherwise, the sewing machines needs to be equipped with another mechanism which can move the feed dog per se in the lateral direction (X direction traversing the feed dog's feeding direction during straight stitch) as well as in the lengthwise direction (i.e. Y direction along which the feed dog's feeding direction during straight stitch). In this case, the sewing machines are expensive.

Furthermore, in a sewing machine which is capable of automatically stitching embroidery names, different font data sets are required for different font sizes. Therefore, the sewing machine is of high cost. If not font data sets corresponding to the fonts which the user desires can be used, the user's desire can be satisfied by buying an optional font data set, which results in problem of cost-burden on the user. Further, the technique of the Patent Document 1, similar to the above, have to be equipped with an XY driving unit which can move the cloth in X and Y directions for sewing a stitch such as embroidery names in satin stitch. as described in the above, the sewing machine is required to be equipped with a XY drive mechanism unit which can move a cloth to both of X direction and Y direction, causing a problem of an increasing the cost for the electronic sewing machine. Furthermore, a sewing machine with the foot controller can instruct the start of the sewing operation and adjust the sewing speed depending on the amount of depression of the foot controller. In this case, though a satin stitch can be made by forming a character on the cloth by free motion sewing when the cloth held by the user is moved after making the feed dog invalid under a bed surface, the fixed value of the swing amount of the needle bar may bring the name embroidering into an unpleasant appearance. Furthermore, with the sewing machine of Patent Document 2, a problem occurs similar to that of the electronic sewing machine of Patent Document 1.

The present invention, which has been made in view of the above problems, has an object to provide a low cost and easy-to-use sewing machine which is capable of adjusting an amount of swing movement of a needle bar while performing free motion sewing of good-looking broidery represented by a satin stitch, or the like.

Means for Solving the Problem

A sewing machine according to the present invention is characterized by comprising: a needle bar being capable of moving vertically and being capable of mounting a needle; a mechanism for vertically moving the needle bar; a needle bar rocking mechanism for rocking the needle bar in the direction lateral to the longitudinal direction in which the feed teeth are fed in rectilinear sewing; and a control unit for adjusting the amount of the amplitude of rocking of the needle bar which is rocked in a free motion sewing mode by the needle bar rocking mechanism. Because the needle is attached to the needle bar, rocking of the needle bar can be replaced by rocking of the needle.

In the free motion sewing, the feed teeth are disabled in the state of the feeding action, and then a user performs the sewing operation while manipulating the fabric with his/her hands. The feed teeth being disabled in the state of the feeding action means that the feed teeth stops feeding the sewing object such as cloth. In this case, measures to lower the feed teeth from the bed and measures to stop the feeding action of the feed teeth can be exemplified. According to the present invention, a control unit can adjust the amount of the amplitude of rocking of a needle bar while performing free motion sewing.

Effect of the Invention

According to the present invention, a control unit can adjust the amount of the amplitude of rocking of a needle bar which is rocked towards the lateral direction (the direction intersecting the lengthwise direction toward which feed teeth are fed in a straight stitch) by the needle bar rocking mechanism while performing free motion sewing mode in performing free motion sewing mode. Thus, when a user makes an embroidery on a sewing object such as fabric, the user can freely and easily manipulate fabric using fingers of both hands. As a result, the present invention can provide a sewing machine that can perform a free motion sewing of good-looking embroidery represented by a Satin stitch, or the like.

Therefore, this renders unnecessary a conventional expensive XY driving mechanism unit which moves a sewing object such as fabric towards both the lateral direction (X direction) and longitudinal direction (Y direction). As a result, there is no need for a conventional expensive XY drive mechanism unit capable of moving fabric in lateral direction (X direction) and lengthwise direction (Y direction). Because of this, a low cost sewing machine can be provided which is capable of making embroidery of Satin stitch such as a profile, a name, etc. for which a user wants. Moreover, since the sewing is performed in free motion sewing, the size and style of letter sewed can be favorably sewed in the desired fonts according to a user's intension.

EXPLANATIONS OF NUMERALS

Figure 1:
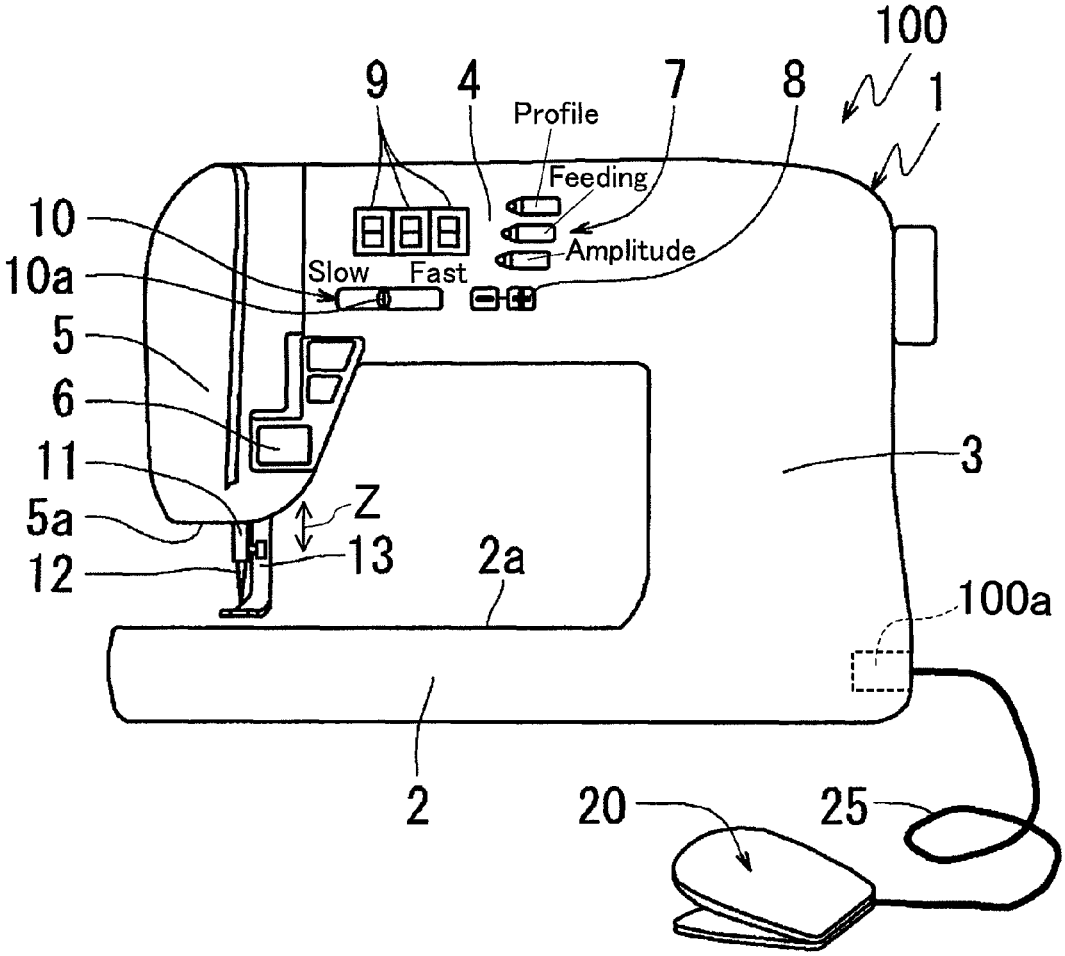
FIG. 1 is a front view of a sewing machine according to a first embodiment.

1 indicates the body of the sewing machine, 2 indicate a bed portion, 8 indicates a change-over switch (switching element), 10 indicates a main body slide variable resistor (adjusting switch), 11 indicates a needle bar, 12 indicates a needle, 13 indicates a presser foot (press element), 14 indicates a throat plate, 15 indicates a feed dog, 20 indicates a foot controller, 30 indicates a microcomputer (control portion), 60 indicates a mechanism for vertically moving a needle bar, 61 indicates a needle bar crank, 62 indicates a crank rod, 70 indicates a needle bar swing movement mechanism, 71 indicates a motor for adjusting an amount of swing movement of the needle bar, 74 indicates a tentering rod, 76 indicates needle bar frame, and 100 indicates a sewing machine.

BEST MODES FOR CARRYING OUT THE INVENTION

A sewing machine according to the present invention can employ the following preferable modes (1)-(9).

(1) The sewing machine includes a foot controller which a user can operate by foot. A control portion controls an amount of lateral swing movement of a needle bar, in free motion sewing mode, based on the operation of the foot controller. Thus, the user can adjust a lateral swing amount of a needle mounted to the needle bar while the user is performing the sewing operation in free motion sewing mode. In this case, while the user is performing the sewing operation in free motion sewing mode, the user can adjust the swing amount of the needle bar in the lateral direction (i.e. the direction traversing a lengthwise direction along which a feed dog moves during straight stitch sewing mode) by controlling the operation of the foot controller. Thus, during sewing operation, the amount of lateral swing movement of the needle which is mounted to the needle bar can be adjusted. In free motion sewing mode, it is desired to make the feed dog inactive.

(2) In free motion sewing mode, when the foot controller is in operation, the control portion turns a mechanism for vertically moving the needle bar "on". If the foot controller is inactive, the control portion turns the mechanism for vertically moving the needle bar "off". In this case, the sewing is carried out based on the operation of the foot controller. The sewing means of entangling upper and lower threads at a work piece to be sewn such as fabric.

(3) The control portion, in free motion sewing mode or during implementing free motion sewing mode, adjusts the lateral swing amount of the needle bar based on the operation of the foot controller. In this case, the lateral swing amount of the needle bar is adjusted in dependence of the operation amount of the foot controller. When a mode other than the free motion sewing is performed, the foot controller adjusts not the swing movement of the needle bar, but a sewing speed represented by vertical movements of the needle bar based on the operation amount of the foot controller.

(4) The sewing machine includes a switching element. The switching element renders the sewing operation selectively free motion sewing mode and another sewing mode. That is, the switching element switches between adjusting the lateral amount of the needle bar by the foot controller during sewing operation under free motion sewing mode and adjusting the sewing speed when the needle bar moves in upward and downward directions during another sewing mode other than free motion sewing mode. Accordingly, the sewing machine can cope with any sewing mode other than free motion sewing mode. With this switching element, an easy switching can be established between adjusting the swing amount of the needle bar and adjusting the sewing speed, the sewing machine can be provided inexpensively which is easy to use inexpensive and which is capable stitching an embroidery of pleasing appearance under, say, saten stich operation mode for pleasing appearance.

(5) The sewing machine includes an adjusting switch which adjust the sewing speed representing the needle bar in vertical movement under free motion sewing mode. Adjusting the sewing speed representing the needle bar in vertical movement renders the free motion sewing in good order.

(6) The sewing machine includes a thread tension adjusting mechanism which makes an upper thread under tension which is supplied to the needle. In this case, the control portion outputs orders to the thread tension adjusting mechanism for providing and relaxing tensions to the upper thread while the sewing machine is in operation and is out of operation, respectively. Relaxing the tension of the upper thread the work piece such as fabric to be sewn is permitted to move while the sewing operation is at rest. The relaxation of the tension is to be understood to include releasing the tension.

(7) The sewing machine includes a thread tension adjusting mechanism which makes an upper thread under tension which is supplied to the needle. In this case, the control portion, under free motion sewing mode, if a free motion sewing operation stop signal is outputted, orders the upper thread tension adjusting mechanism to maintain the tension of the upper thread until a time $\Delta T$ elapses after issuing the free motion sewing operation stop signal, and upon elapse of the time $\Delta T$ the upper thread tension adjusting mechanism relaxes the tension of the upper thread. The time $\Delta T$ is exemplary within a range between 0.5 and 2.0 seconds, particularly between 1.0 and 1.5 seconds, but is not limited thereto.

(8) The foot controller includes first and second foot operating parts. In this case, the control portion, under free motion sewing mode or during implementing free motion sewing operation, adjusts the amount of swing movement of the needle bar which is brought into a lateral swing movement by a needle bar swing mechanism, based on an operation of the first foot operating part. Furthermore, the control portion adjusts the sewing speed representing the vertical movements of the needle bar based on and operation of the second foot operating part.

(9) The foot controller is operated by at least a portion of the user's leg (foot, ankle, knee, shin, thigh, toe, or the like). Thus, the foot controller is not limited to be operated by a mode of the depression of user's tiptoe and is configured to operate by a mode of manipulation by moving the user's knee and/or thigh.

Embodiment 1

FIG. 1 is a front view of a sewing machine according to a first embodiment of the present invention. As shown in FIG. 1, the sewing machine 100 includes a sewing machine main body 1 and a foot controller 20 which is detachably mounted to the sewing machine main body 1 for serving as an operating controller. A plug (not shown) provided at one end of a connection cord 25 of the foot controller 20 is detachably connected to a jack 100*a* which is provided in a lower side of a right surface of a column leg portion 3 as viewed in FIG. 1.

As shown in FIG. 1, the sewing machine main body 1 includes a bed portion 2, the column leg portion 3 upstands vertically from a right end portion as viewed in FIG. 1 of the bed portion 2, as viewed in FIG. 1, and an arm portion 4 extending from an upper end of the column leg portion 3 so as to oppose to an upper surface of the bed portion 2. A front surface of a head portion 5 of the arm 4 is provided with a start switch 6 for initiation and termination controls of a sewing operation. In addition, a front surface of the arm 4 is provided with a selection mode display and selection switch 7, a changing-over switch 8 (switching element) for selecting a pattern etc by switching, 7-segment LEDs 9 (display element) which displays a revolution speed of a main shaft 53 (FIG. 4) and a pattern number etc, and a main body slide variable resistor 10 for adjusting a sewing speed (an adjusting switch for a sewing speed in free motion sewing).

Figure 2:
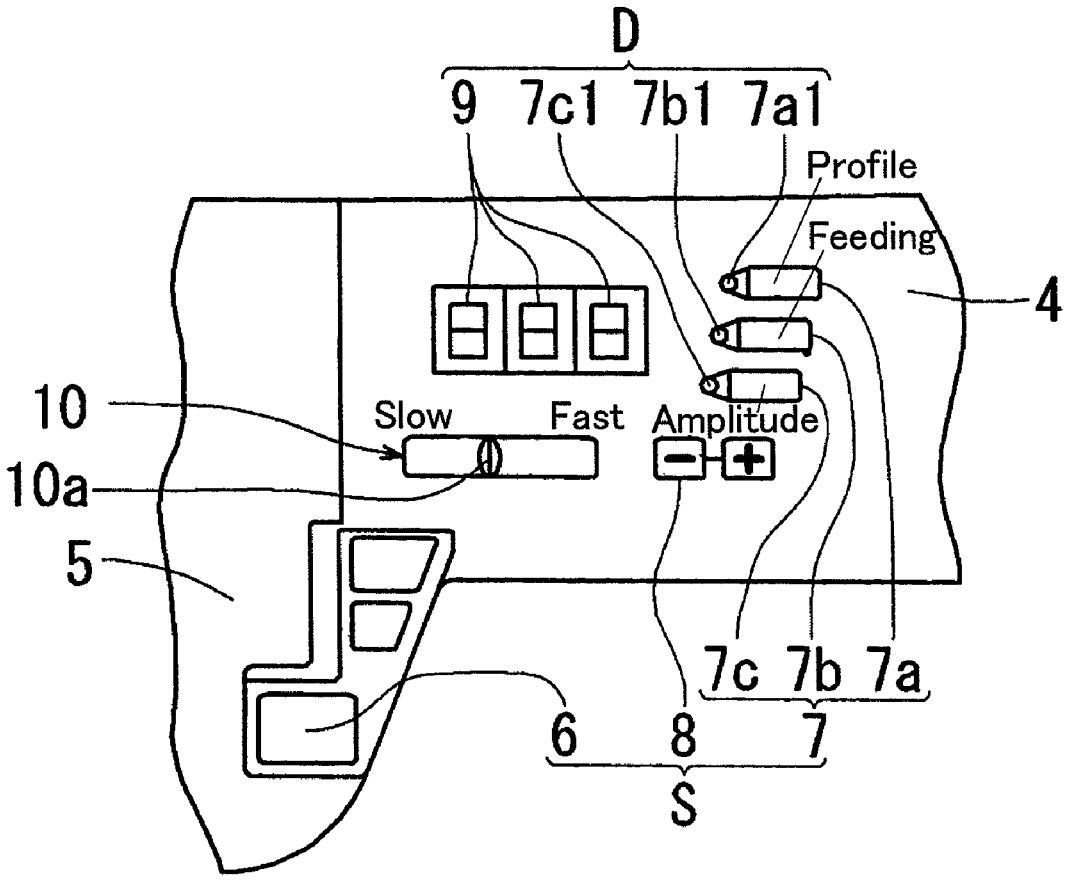
FIG. 2 is a partially enlarged view of a front of an arm in the first embodiment.

FIG. 2 is a partial enlarged view of the front surface of the arm 4. As shown in FIGS. 1 and 2, the selection mode display & selection switch 7 has a pattern number display & selection switch 7*a*, a feeding amount of feed dog 13 (FIG. 3) display & selection switch 7*b*, and a swing amount of a needle 12 display & selection switch 7*c*, all of which instruct of the respective LEDs 9 as to what contents are to be displayed. When the display & selection switches 7*a*, 7*b*, and 7*c* which act as user-operable switches are brought into key operation, respective display lams 7*a*1, 7*b*1, and 7*c*1 are turned on or lit, the resulting conditions remain unchanged unless another change-over switch is manipulated. That is, only the last manipulated changing-over switch is being in its on-state. As shown in FIG. 2, the display lamps 7*a*1, 7*b*1 and 7*c*1, and the 7-segment LEDs 9 constitute a display portion D. In addition, the start switch 6, the selection mode display & selection switch 7, and a changing-over switch 8 for selecting pattern numbers etc constitute a main body switch S. The main body switch S is to be operated by the user.

Figure 3:
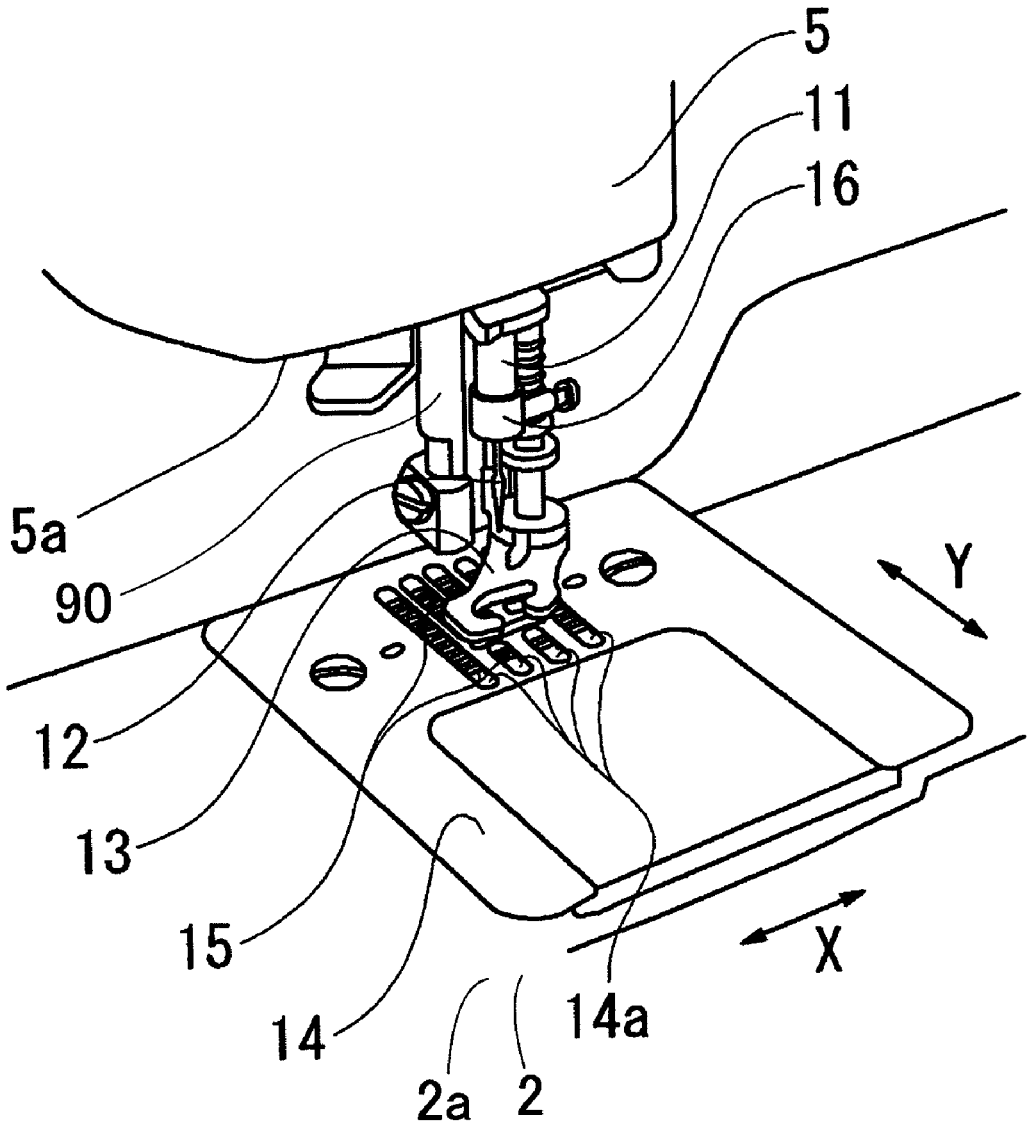
FIG. 3 is an enlarged perspective view of a portion in the vicinity of a needle of the needle in the first embodiment.

FIG. 3 is an enlarged perspective view of surroundings of a needle 12 which is provided at a side of a lower surface 5*a* of the head portion 5. As shown in FIGS. 1 and 3, the needle 12 mounted on a distal end of a needle bar 11 and a presser foot 13 (holding element) which is detachably mounted to a presser bar 90 for vertical movement therewith extends from the lower surface 5*a* of the head portion 5. A feed dog 15 is provided in a slot 14*a* of a throat plate 14, which is provided on the upper surface 2*a* of the bed portion 2, in order to feed a fabric (a work piece to be sewn) in a lengthwise direction or Y direction during straight stitch sewing. In addition, in free motion sewing, with the feed dog 15 made inactive in operation, the user can handle freely the fabric at hand for stitching thereon. Accordingly, in free motion sewing, the user freely moves the at-hand fabric in the lengthwise direction (Y direction in FIG. 3, fore-and-aft direction) and a lateral direction (X direction in FIG. 3) under a condition that the feed dog is made inactive by being placed below the upper surface 2*a* of the bed portion 2. In the meantime, in case of a sewing machine without a function of lowering the feed dog 15, placing an auxiliary plate (not shown) on the throat plate 14 for covering the feed dog 15 will make the feed dog 15 inactive in operation. The presser foot 13 moves in synchronization with the needle 12 such that the presser foot 13 presses the fabric just before the needle 12 penetrates the fabric, continues to press the fabric until the needle 12 escapes completely from the fabric, and moves upwardly immediately upon escapement of the needle 12 from the fabric. Here, the user can freely move the fabric in the X and Y directions (FIG. 3). Meanwhile, even if the presser foot 13 is not provided, free motion sewing can be performed. In this case, in order to prevent the fabric from getting loose, the user may take action such as using a frame for thread embroidering or pressing the fabric near the needle by finger.

Figure 4:
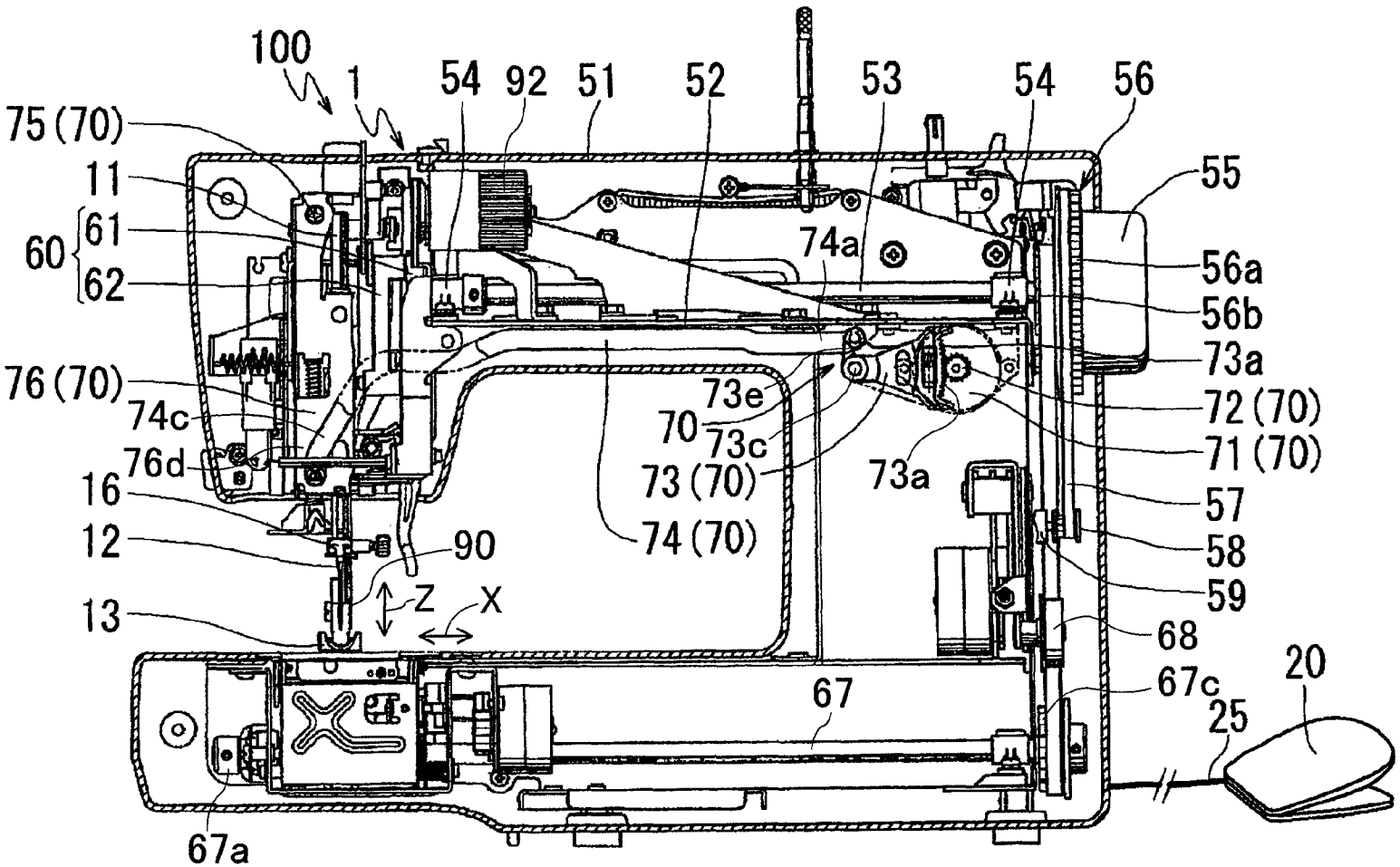
FIG. 4 is a front view showing an interior structure of a main body of the sewing machine of the first embodiment of the invention.

FIG. 4 is a front view showing an internal mechanism of the sewing machine main body 1 of FIG. 1. As shown in FIG. 4, an outer shall 51 of the sewing machine main body 1 includes therein a frame 52. A main shaft 53 is supported by a pair of shaft bearings 54 and 55 which are fixed to the frame 51 to rotate freely and extend horizontally. A hand wheel 55 and a pulley 56 are fixedly mounted to one end of the main shaft 53. The pulley 56 has a large-diameter driven pulley 56*a* and a small-diameter timing pulley 56*b*. The frame 52 is equipped with a main motor or a for-main-shaft motor 59 (only a portion of which is shown in FIG. 4). A motor pulley 58 is fixedly mounted on an output shaft 58 of the for-main-shaft motor 59. A lower shaft 67 having a timing pulley 67*c* is supported by shaft bearings 67*a* to rotate in the bed portion 2. An endless drive belt 57 is tracked over the motor pulley 58, the timing pulley 67, and the driven pulley 56*a*. With the driving belt 57, rotation of the for-main-shaft motor 59 is reduced at a reducing ratio (e.g. approximately 1/9) before being transmitted to the main shaft 53 and lower shaft 67. A tension pulley 68 is in abutment with the driving belt 57.

As shown in FIG. 4, there is provided is a needle bar vertical reciprocal movement mechanism 60 for moving vertically the needle 11 in reciprocal manner. As is known in the art, a needle bar crank 61 is fixed to the other end of the main shaft 53. The needle bar vertical reciprocal movement mechanism 60 is made up of the needle bar crank 61 and a crank rod 62 connected to the needle bar crank 61. The needle 12 is fixed to the lower end of the needle bar 11 by a needle clamp 16. The needle 12 reciprocates in a vertical direction (Z direction) with the needle bar 11 as a unit. An upper end portion of a needle bar arm 76 is made capable of swinging in the lateral direction (X direction). The needle bar 11 is in pivotal support by the needle bar arm 76 to swing the lateral (X direction).

Here, a needle bar swing mechanism 70 which brings the needle 12 into a swing movement in the lateral direction (X direction) includes a swing amount adjusting motor 71 which is in the form of a stepping motor and which is retained in the frame 52, a small gear wheel 72 driven by the swing amount adjusting motor 71, a swing drive arm 73 having a sector gear wheel 73*a* being in meshing engagement with the small gear wheel 72, a pivot axis 73*c* about which the swing drive arm 73 swings, a swing amount rod 74 extending in the X direction, and the needle bar arm 76 which is supported by the shaft 75 to swing. That is, the small geared wheel 72 is mounted to a shaft of the swing amount adjusting motor 71 for adjusting the swing amount. The small geared wheel 73 is in engagement with the sector geared wheel 73*a* of the swing amount drive arm 73. One end 73*e* of the swing amount drive arm 73 is connected with an end 74*a* of the swing amount rod 74. The other end 74*c* of the swing amount rod 74 is connected to the lower portion 76*d* of the needle bar arm 76. When the swing amount adjusting motor 71 is turned on, the resulting drive force is transmitted, via the small geared wheel 72 and the swing amount drive arm 73, to the swing amount drive rod 74 for movement thereof in the X direction, and then to the needle bar arm 76. As a result, the needle bar 11 is brought into swing movement in the lateral direction (X direction) about the shaft 75. In such a way, the swing amount adjusting motor 71 under the computer control, in synchronization with the rotation of the main shaft 53, causes the needle bar 71, via the swing amount drive rod 74, to swing in the lateral direction (X direction). The driving amount of the swing amount adjusting motor 71 determines the amount of the swing movement of the in the lateral direction (X direction).

The sewing machine 100 (FIG. 1) includes the foot controller 20 to be operated by the user's leg. In normal modes other than free motion sewing, the foot controller 20 is used to adjust the sewing speed of needle bar 11 which moves in a vertical direction (Z direction) in reciprocation manner. In normal modes other than free motion sewing, it is preferable to utilize the feeding action of the feed dog 15. On the other hand, in the free motion sewing mode, the foot controller 20 is used to adjust the swing amount of the needle bar 11 and that of the needle 12 in X direction. The needle 12 is mounted on the distal end portion of the needle bar 11.

Therefore, the sewing speed and the swing amount of the amplitude of the needle bar 11 are equal to the sewing speed and the swing amount of the needle 12. Hereinafter, the swing amount means the swing amount of either of the needle bar 11 and the needle 12 in X direction. In addition, the sewing speed means the reciprocal speed of each of the needle bar 11 and the needle 12 in the vertical direction (Z direction) and the revolution speed of the main shaft 53 (hereinafter also referred to as 'main shaft rpm'). A depression amount (an operation amount) of the foot controller 20 corresponds to an adjustment in the sewing speed in normal modes other than free motion sewing and an adjustment in the swing amount of the needle bar 11 in X direction. Switching between free motion sewing mode and the other modes is carried out by mode selection using the changing-over switch 8 (switching element) for selection of pattern number etc. For example, only when the changing-over switch 8 designates 'Satin name' in the pattern mode, free motion sewing mode is selected. In this case, when the foot controller 20 is depressed, the resulting output signal serves as a swing amount adjusting signal for adjusting the swing amount of each of the needle bar 11 and the needle 12 in X direction. In other modes, when the changing-over switch 8 designates an item other than the 'Satin name', when the foot controller 20 is depressed, the resulting output signal serves as a sewing speed adjusting signal for adjusting a sewing speed corresponding to a moving speed of each of the needle bar 11 and the needle 12 I in Z direction.

Figure 5:
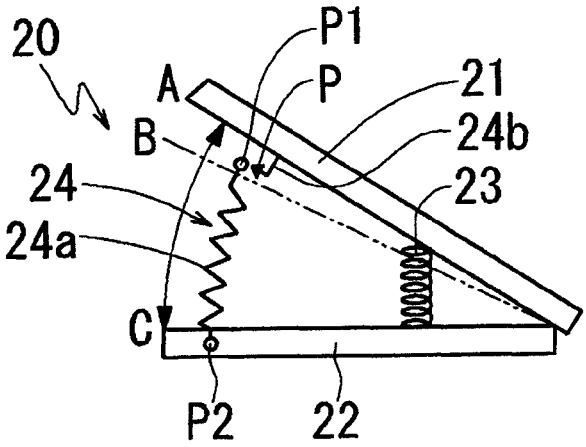
FIG. 5 is an explanatory view illustrating a structure and operation of a foot controller in the first embodiment.

FIG. 5 shows an operation principle of the foot controller 20. As shown in FIG. 5, the foot controller 20 includes a variable resistor 24 provided therein, a pedal 21 which is to be depressed by a leg of the user 2, a wiper 24*b* being in operative association with the pedal 21, a base 22 equipped with the variable resistor 24, and a return spring 23 mounted between the pedal 21 and the base 22 for returning the pedal 21 to its original position. A constant DC voltage is applied across terminals Pa and P2 at both legs of the variable resistor 24. A moving contact P of the wiper 24*b* of the variable resistor 24 is in sliding contact with a resistor body 24*a* based on the operation of the pedal 21.

In other words, in a free state wherein the pedal 21 is not depressed, the moving contact P locates on at a position A. When the pedal 21 is depressed against an elastic force of the return spring 23, the moving contact P is out of contact with the resistor body 24*a* during an idle interval between the point A and a point B wherein the point A is closer to the original position than the point B. At the point B, the variable resistor is brought into its connected state. Furthermore, the resistor body 24*a* of the wiper 24*b* slides along the resistor body 24*a* during movement from the point B to a point C. The depression amount (operation amount) of the pedal 21 is determined by the voltage applied across an operating point P of the wiper 24*b* and the terminal P2. If the user depresses the pedal 21, the resulting output signal (analog signal) is inputted to a microcomputer 30 (control portion). In the microcomputer 30, the output signal (depression amount) of the foot controller 20 is brought into an A/D conversion based on conversion value (see Table 1) of the voltage across the wiper 24*b* and the terminal P2.

Table 1 shows a relationship (*1) between the depression amount (operation amount) of the foot controller 20 and the main shaft rpm in other modes than free motion sewing. In addition, Table 1 shows a relationship (*2) between the depression amount (operation amount) and the swing amount of the needle bar 11 in X direction in free motion sewing. As shown in Table 1 and FIG. 5, when the moving point P of the wiper 24*b* is at between the positions A and B, the moving point P is out of connection with the variable resistor 24. At the position B, the moving point P begins to connect with the variable resistor 24. At point C, the depression amount of the pedal 21 (operation amount) reaches its maximum. As shown in Table 1, A/D conversion values of the pedal 21 at the positions A, B, and C i.e. values calculated by the microcomputer 30 are 255, 200, and 25, respectively, in relative value. However, the values are not limited to the above values. The depression amount between the positions B and C is divided into plural (9) equal values. The A/D conversion values between A and B and between B and C are set as shown in Table 1. Meanwhile, the A/D conversion values are not limited to the values shown in Table 1.

Figure 17:
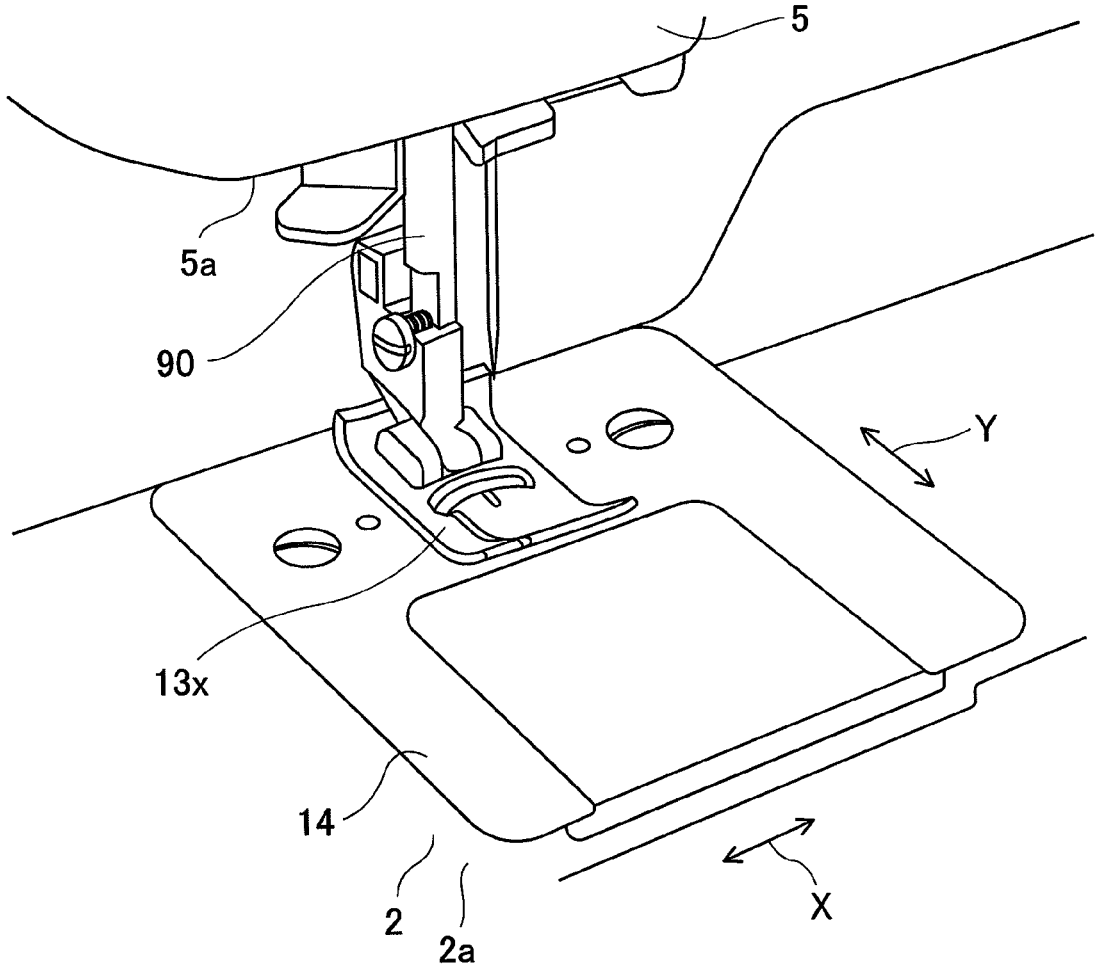
FIG. 17 is an enlarged perspective view of a needle according to another embodiment.

As described above, *1 of Table 1 shows mode other than Satin stitch embroidery mode (one of normal modes other than the free motion sewing mode). As shown as *1 in Table 1, the main shaft rpm is set to be, e.g. 30 rpm at the position B, and e.g. 770 rpm at the position C, based on an indicated value of the main body slide variable resistor 10 of the main body switch S. In this mode, the swing amount of the needle bar 11 when the pedal 21 is at between the positions B and C follows the indicated value of the main body switch S, resulting in remaining the swing amount unchanged even though the depression amount of the foot controller 20 is changed. The presser foot 13 moves vertically in synchronization with the needle 12. Meanwhile, in mode other than free motion, as shown in FIG. 17, a presser foot 17X which is different from the above-mentioned presser foot 13. In this case, the presser foot 13X is out of synchronization with the needle 12.

*2 of Table 1 shows *2 of Table 1 shows free motion sewing mode such as Satin stitch or the like. In this case, as indicated at *2 of Table 1, at the positions B and C, the swing amounts of the needle bar 11 are set to be 0.0 mm, and 5.0 mm, respectively. The swing amount of the needle bar 11 corresponding to the A/D conversion values in between positions B and C are set as *2 of Table 1. In free motion sewing mode such as Satin stitch or the like, the rotation speed of the main shaft follows, between the positions B and C, the indication value of the main body slide variable resistor 10 (adjusting switch).

TABLE 1

| | | *1 | | *2 | |
|---|---|---|---|---|---|
| position in FIG. 5 | A/D conversion value | rotational speed of main shaft(rpm) | amplitude of rocking (mm) | rotational speed of main shaft(rpm) | amplitude of rocking (mm) |
| A: position in a free state of the pedal section to the start of connection of variable resistor | 255.0 | OFF | — | OFF | — |
| B: start position of connection of variable resistor | 200 | 30 | | | 0.0 |
| depression amount (small ↑) | 182 | 104 | based on the indicated value of the body switch S | ON based on the indicated value of the body slide volume 10 | 0.5 |
| | 165 | 178 | | | 1.0 |
| | 147 | 252 | | | 1.5 |
| | 130 | 326 | | | 2.0 |
| | 112 | 400 | | | 2.5 |
| | 95 | 474 | | | 3.0 |
| | 77 | 548 | | | 3.5 |
| | 60 | 622 | | | 4.0 |
| | 42 | 696 | | | 4.5 |
| (↓ big) | | | | | |
| C: maximum depression value | 25 | 770 | | | 5.0 |

Figure 6:
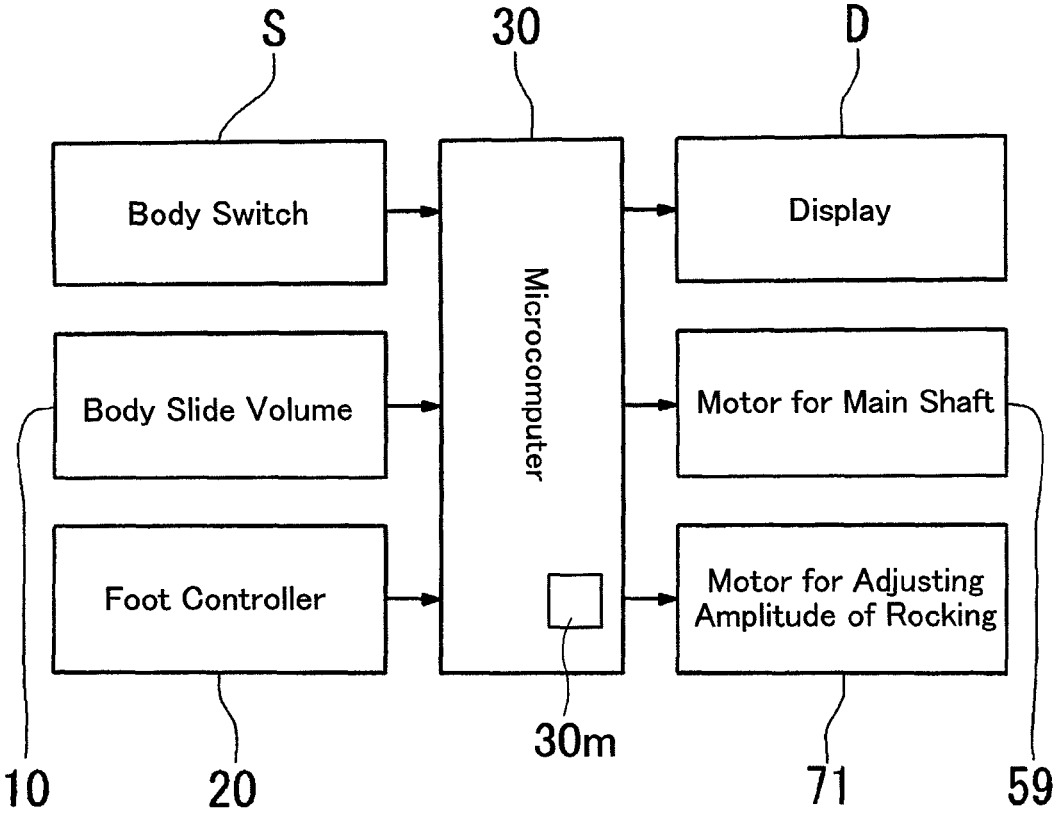
FIG. 6 is an explanatory view of a micro computer provided in the machine body in the first embodiment.

FIG. 6 is an explanation of an input/output of the microcomputer 30 built in the sewing machine body 1. As shown in FIG. 6, the sewing machine 100 includes therein the microcomputer 30 (control portion, hereinafter sometimes referred to as "micon"). Here, the main body switch S (FIG. 6 and FIG. 1) includes the start switch 6, switches 7*a*, 7*b*, and 7*c* constituting the selection mode display & selection switch 7, and the changing-over switch 8. Operation signals of the respective each of the switches 6, 7*a*, 7*b*, 7*c* and the change-over switch 8 are inputted to the microcomputer 30. Then, the microcomputer 30 performs a process based on data prestored in its memory 30*m*. That is, in correspondence with the processing result, instructions are outputted to the following elements, i.e. a display portion D, the for-main-shaft motor 59 for a main shaft, and the swing amount adjust motor 71 (FIGS. 6 and 1). As described before, the display D is made up of the 7-segment LEDs 9 and the display lamps 7*a*1, 7*b*1, and 7*c*1 (FIG. 2).

When the user depresses the pedal 21 of the foot controller 20, an output signal which is indicated in Table 1 and which corresponds to the depressing amount is inputted to the micon 30. When any one of modes other than free motion sewing is selected, the output signal from the foot controller 20 adjusts the revolution speed of the for-main-shaft motor 59 (*1 of Table 1) and therefore the sewing speed of the needle bar 11 and the needle 12 during the vertical movements thereof.

In contrast, when free motion sewing mode such as Satin stitch or the like is selected, the output signal from the foot controller 20 adjusts a swing angle of the swing amount adjusting motor 71 and therefore the swing amounts of both the needle bar 11 and the needle 12 in the lateral direction (X direction) can be adjusted. In such free motion sewing mode, as described before, the revolution speed of the for-main-shaft motor 59 and therefore the sewing speed of the needle bar 11 and the needle 12 in the vertical direction are determined based on an adjusted position of an adjusting slide knob 10*a* of the main body slide variable resistor 10 (adjusting switch). It is common to fix the fabric to an embroidery frame in free motion sewing such as embroidering sewing. It is preferred to make the feed dog 15 inactive. Making the feed dog 15 invalid can be established by, say, manipulating a drop feed knob (not shown) at a back surface of the bed portion 2 and otherwise placing the auxiliary plate (not shown) on the throat plate 14.

Meanwhile, when the foot controller 20 is not connected to the sewing machine main body 1, the main body slide variable resistor 10 adjusts the revolution speed of the main shaft 53 or the sewing speed. In this case, manipulating the main body slide variable resistor 10 causes the output signal from the main body slide variable resistor 10 to be inputted to the micon 30 for adjusting the revolution speed of the for-main-shaft motor 59, thereby adjusting the sewing speed of the needle 12 during its vertical movement. Furthermore, when the foot controller 20 is connected to the sewing machine main body 1, if any one of modes other than free motion sewing is selected, depression of the foot controller 20 will adjust the sewing speed of the vertical motion of the needle 12. In addition, when the foot controller 20 is not connected to the sewing machine main body 1, start and stop of the sewing machine main body 1 is based on the start switch 6, and the adjustment of the sewing speed depends on the main body slide variable resistor 10. When the foot controller 20 is not connected to the sewing machine main body 1, in order to prevent a user's error, it is possible for the change-over switch 8 which is designed for changing pattern number to make selecting the 'Satin stitch embroidery mode' inactive. That is, selecting free motion sewing mode may be made inactive.

Thus, when the foot controller 20 is not connected to the sewing machine main body 1, it is possible to make selecting free motion sewing mode inactive, and any mode other than free motion sewing is performed. According to the present embodiment, the foot controller 20 is used for adjustment in the sewing speed (the vertical movement speed of the needle 12 in Z direction) in normal mode and is used for adjusting the swing amounts of the respective needle bar 11 and the needle 12 in X direction in free motion sewing mode.

Figure 7:
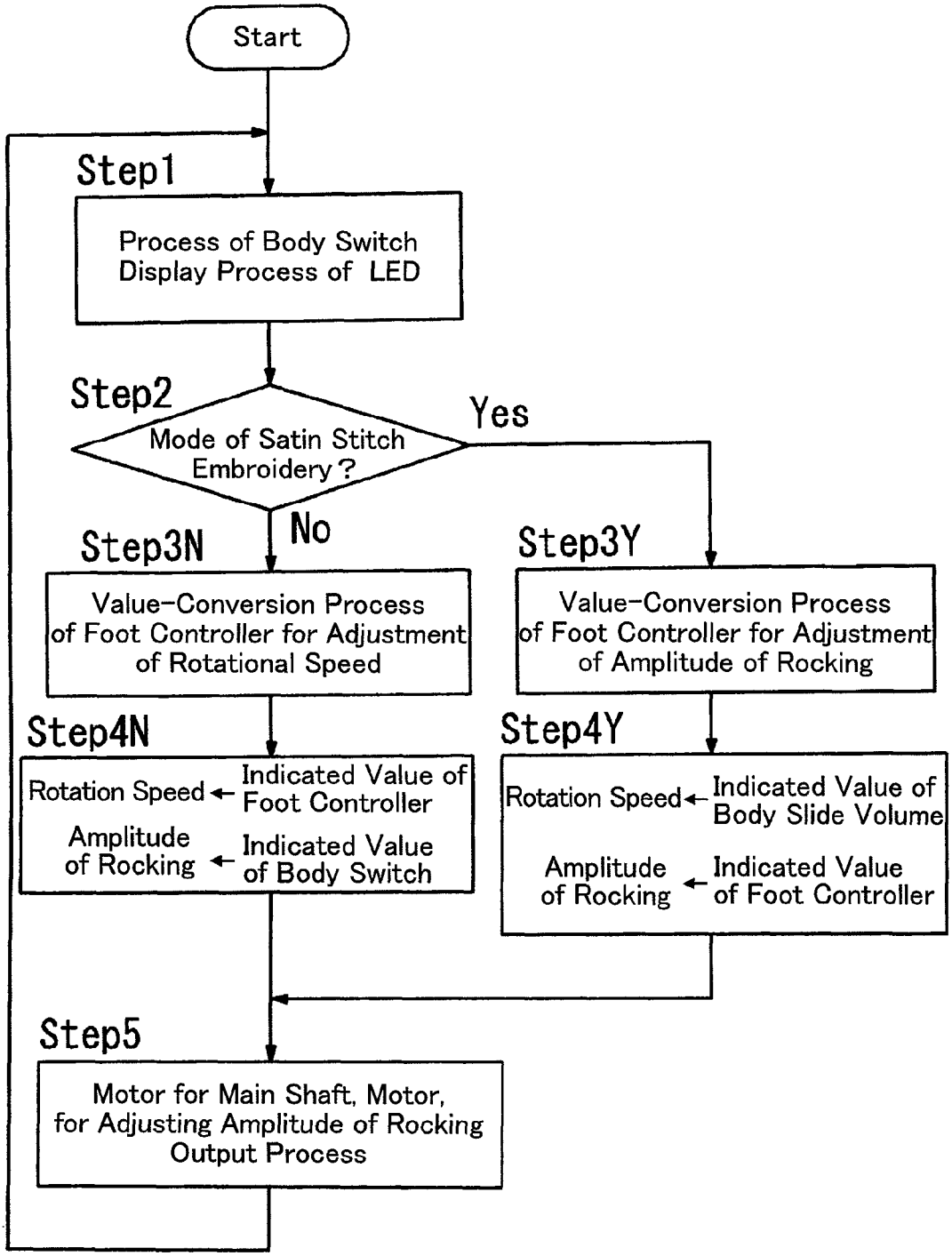
FIG. 7 is a flow chart showing control of the sewing machine according to the first embodiment.

(Control) FIG. 7 is an exemplary flowchart showing a sewing operation of the sewing machine 100 of FIG. 1. However, the flowchart is not limited to this. As shown in FIG. 7, the sewing operation of the sewing machine 100 includes Step 1, Step 2, Step 3N, Step 4N, Step 3Y, Step 4Y, and Step 5. If a power source of the sewing machine 100 is turned off, the processing of the micon 30 is stopped. Each of the steps, when the foot controller 20 is connected to the sewing machine main body 1, will be described.

In step 1, the micon 30 reads the main body switch S (specifically, the selection mode display & selection switch 7) which the user manipulates and outputs corresponding display signal to the display portion D. That is, when the user manipulates the pattern number display & selection switch 7*a*, the display lamp 7*a*1 is lit and the current pattern number is played on the 7-segment LED 9. When the user manipulates the feeding amount display & selection switch 7*b*1 is lit and feeding amount of the feed teeth 15 (FIG. 3) is displayed on the 7-segment LED 9. When the user manipulates the swing amount display & selection switch 7*c*, the display lamp 7*c*1 is lit and the swing amount of the needle 12 is displayed on the 7-segment LED 9. Meanwhile, it is possible for the 7-segment LED 9 to display the main shaft rpm speed overridingly.

In step 2, the micon 30 determines whether or not Satin stitch embroidery mode (free motion sewing mode) has been selected. In this case, the microcomputer 30 reads the operation condition of the changing-over switch 8. Specifically, under on-condition of the pattern number display & selection switch 7*a*, when the user manipulates a (+) key of the changing-over switch 8 shown in FIG. 1, the pattern number increases by 1. When the user manipulates a (−) key, the pattern number profile/number decreases by 1. Thereby, either Satin stitch embroidery mode (free motion sewing mode) or the mode other than the Satin stitch embroidery mode (the mode other than the free motion sewing) is selected. If the Satin stitch embroidery mode is selected, the micon 30 proceeds to step 3Y. If the mode other than the Satin stitch embroidery mode is selected, the micon 30 proceeds to step 3N.

In step 3Y, a value-conversion process of the foot controller 20 is performed based on the depression amount of the pedal 21 of the foot controller 20. That is, under the condition that the Satin stitch embroidery mode is selected, an analog value of the depression amount of the pedal 21 that corresponds to the swing amount of the needle 12 is brought into analog-to-digital conversion by the micon 30. Then, the control of the micon 30 proceeds to step 4Y. In step 4Y, the micon 30 determines the swing amount of the needle 12 based on the A/D conversion value of the depression amount of the pedal 21 and a data value of Table 1 (*2 of Table 1) pre-stored in the memory 30*m* of the micon 30. Meanwhile, the main shaft rpm is determined by the indicated value of the adjusting slide knob 10*a* of the main body slide variable resistor 10 and data (*2 of Table 1) pre-stored in the memory 30*m* of the micon 30. Then, the micon 30 proceeds to step 5. In step 5, the indicated value of the swing amount of the needle 12, which is determined in step 4Y by the micon 30, is inputted to a drive circuit of the swing amount adjusting motor 71. The swing amount adjusting motor 71 swings depending on the indicated value of the swing amount. Similarly, the indicated value of the revolution speed of the main shaft 53, which is determined by the micon 30, is inputted to a drive circuit (not shown) of the for-main-shaft motor 59. The for-main-shaft motor 59 rotates according to the indicated value of the main shaft motor 59. If a cycle of the Satin stitch embroidery mode is terminated as mentioned above, the micon 30 returns to step 1. Thus, sequential performances of the cycle of the Satin stitch embroidery mode bring in a Satin stitch embroidery.

If the mode other than the Satin stitch embroidery mode (the mode other than the free motion sewing) is selected, the micon 30 proceeds from step 2 to step 3N. In step 3N, when the foot controller 20 is depressed, the sewing speed is adjusted for the vertical movement of the needle 12. That is, an analog value of the depression amount of the pedal 21, which corresponds to a value for adjusting the sewing speed, is inputted to the micon 30 and then is, therein, analog-to-digital converted (*1 of Table 1). Then, the micon 30 proceeds to step 4N. In step 4N, the main shaft rpm is determined by an A/D conversion value according to the depression amount and a data value of Table 1 (*1 of Table 1) pre-stored in the memory 30*m* of the micon 30. The swing amount the needle 12 is based on the indicated value of the main body switch S (specifically, the switch 7*c* and/or the changing-over switch 8). Meanwhile, if the indicated value of the main body switch S does not vary, a recommended value is set at the time when a pattern is selected. The swing amount of the needle 12 is determined by an indicated value of the main body switch S (specifically, the switch 7*c* and/or the changing-over switch 8) and data (*1 of Table 1) pre-stored in the memory 30*m* of the micon 30. Thereafter, the micon 30 proceeds to step 5 from step 4N.

Next, the user's operation procedure will be explained when Satin stitch embroidery (free motion sewing) is executed using the sewing machine 100. First, the feed dog 15 is made inactive by being lowered in the slot 14*a* of the throat plate 14. Furthermore, the presser foot 13 is mounted to the sewing machine main body 1, rendering a sewing operation being ready. Then, the foot controller 20 is connected to the sewing machine main body 1. The user turns the pattern number display & selection switch 7*a* on and manipulates the changing-over switch 8 to select the Satin stitch embroidery mode (free motion sewing mode). The selecting result is displayed on the 7-segment LEDs 9 as a numerical number. In regard to the sewing speed (corresponding to the main shaft rpm), the user adjusts it by manipulating the adjusting slide knob 10*b* of the main body slide variable resistor 10 (an adjusting switch for adjusting a sewing speed in free motion sewing). Next, fabric (work piece to be sewn) is placed on the throat plate 14 and is held by the user's hands. The user performs the free motion sewing for an embroidery in such a manner that the user depresses the foot controller 20 while manipulating the fabric with the hands for adjusting the swing amount to the user's choice by adjusting the depression amount of the foot controller 20.

Here, the presser foot 13 vertically moves in synchronization with the needle 12. Immediately wen the needle 12 comes off the fabric, the presser foot 13 is released from the fabric. Between the time point of the immediate after the release of the presser foot 13 and the time point just before the needle 12 penetrates the fabric or the time point when the presser foot 13 presses the fabric down again, the user can move the fabric at will to sew a Satin stitch pattern of the user's taste. Meanwhile, sometimes the presser foot 13 is allowed to detach from the sewing machine. During such embroidery, if the sewing speed (main shaft rpm) is required to be adjusted, the user adjusts it by manipulating the adjusting slide knob 10*a* of the main body slide variable resistor 10. Here, the 7-segment LEDs 9 as an element of the display portion D, displays the main shaft rpm, i.e. the sewing speed.

In free motion sewing as described before, the user can adjust the swing amount of the needle bar 11 in the lateral direction (X direction) with respect to the lengthwise direction (Y direction) along which the feed dog 15 moves in straight stitch by adjusting the depression amount of the foot controller 20 while performing the free motion sewing. Thus, the user can adjust the swing amount of the needle 12 in the lateral direction (X direction) which is mounted to the needle bar 11 while performing the free motion sewing. As a result, upon making embroidery such as e.g. a name or the like in free motion sewing, the user can sew embroidery of Satin stitch by adjusting the swing amount of the needle 12 while manipulating the fabric with the hands. As a result, there is no need for an expensive XY drive mechanism unit capable of moving a fabric in both lateral direction (X direction) and longitudinal directions (Y direction). Because of this, a low cost sewing machine can be provided which is capable of making embroidery of Satin stitch such as a pattern, a name, etc. for which a user wants. Moreover, free motion sewing makes it possible for a size and style of letter and fonts to be sewn to adjust at the user's will. Thus, the purchasing a user's favorites font data set is not required.

As described before, the sewing machine 100 includes the foot controller 20 and can adjust the swing amount of the needle 12 in the lateral direction when an operation is made to depress the pedal 21 of the foot controller 20. Thus, when stitching embroidery, the user can manipulate freely and easily a fabric with fingers of both hands, causing the resulting embroidery of Satin stitch to be outstanding.

In addition, in the conventional sewing machine having the foot controller 20, only the sewing speed (main shaft rpm) can be adjusted by the depression amount of the foot controller 20. In contrast, the present embodiment includes the changeover switch 8 (switching element) which utilizes the existing foot controller 20 for the selection of adjusting the sewing speed of the needle 12 in the normal mode and adjusting the swing amount of the needle 11 in the lateral direction in the free motion sewing. This changing-over switch 8 makes it possible to establish an easy switching between the adjustment of the swing amount of the needle 12 and the adjustment of the sewing speed of the needle 12, thereby providing the sewing machine 100 of low cost in production which is convenient to use and which is capable of implementing the free motion sewing such as Satin stitch embroidery of outstanding appearance.

Embodiment 2

Figure 8:
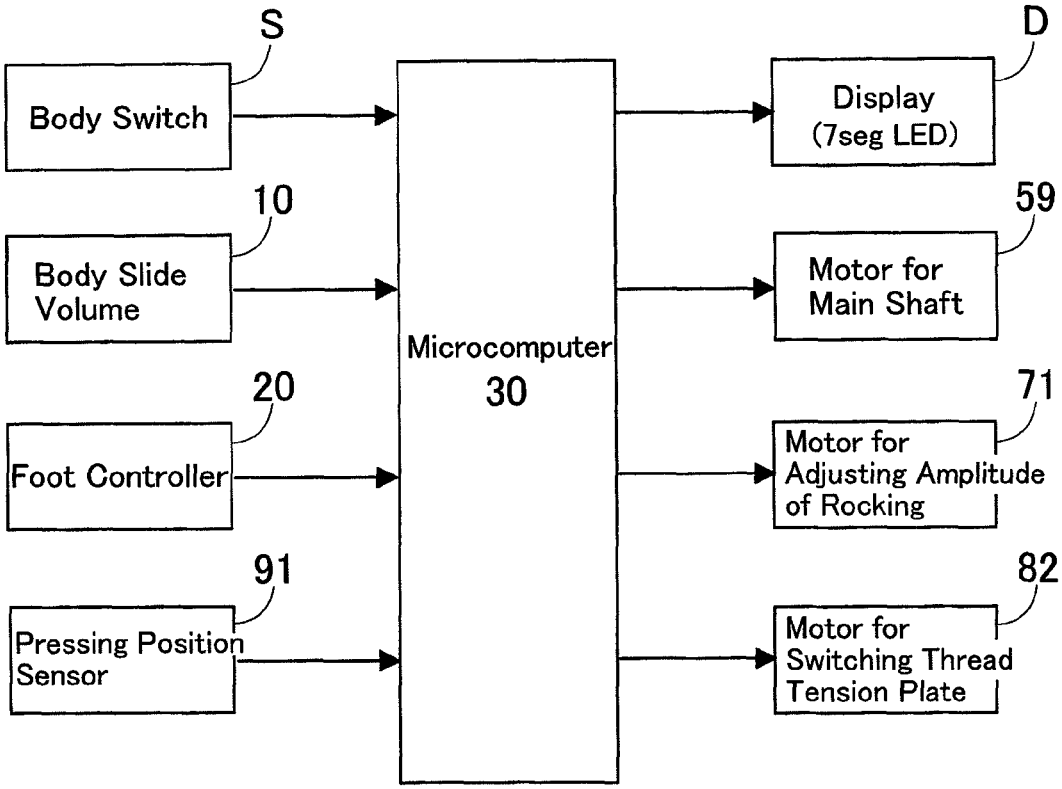
FIG. 8 is an explanatory view illustrating input and output of a micro computer provided in a main body of a sewing machine according to the second embodiment.
Figure 9:
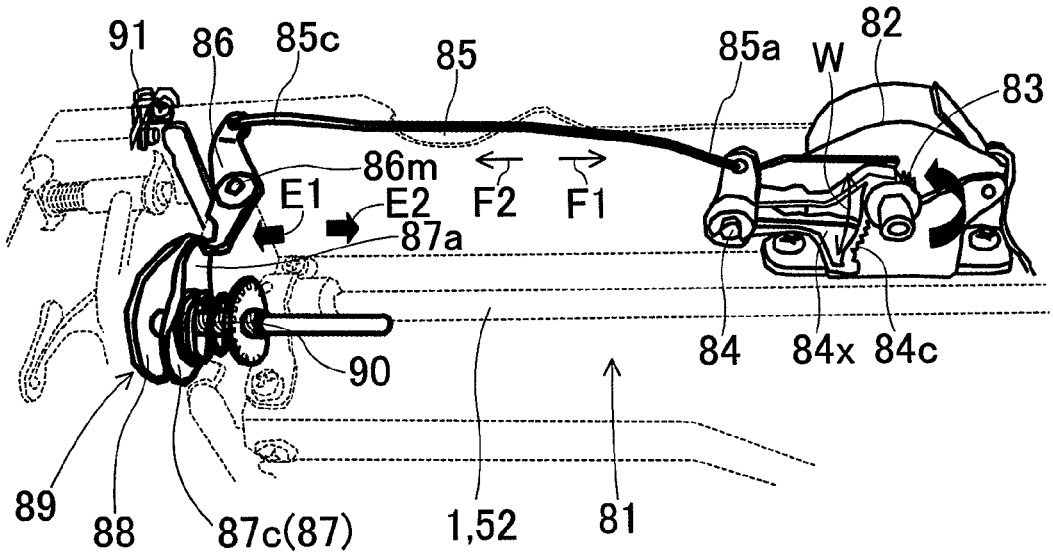
FIG. 9 is a perspective view of an upper thread tension adjusting mechanism.
Figure 10:
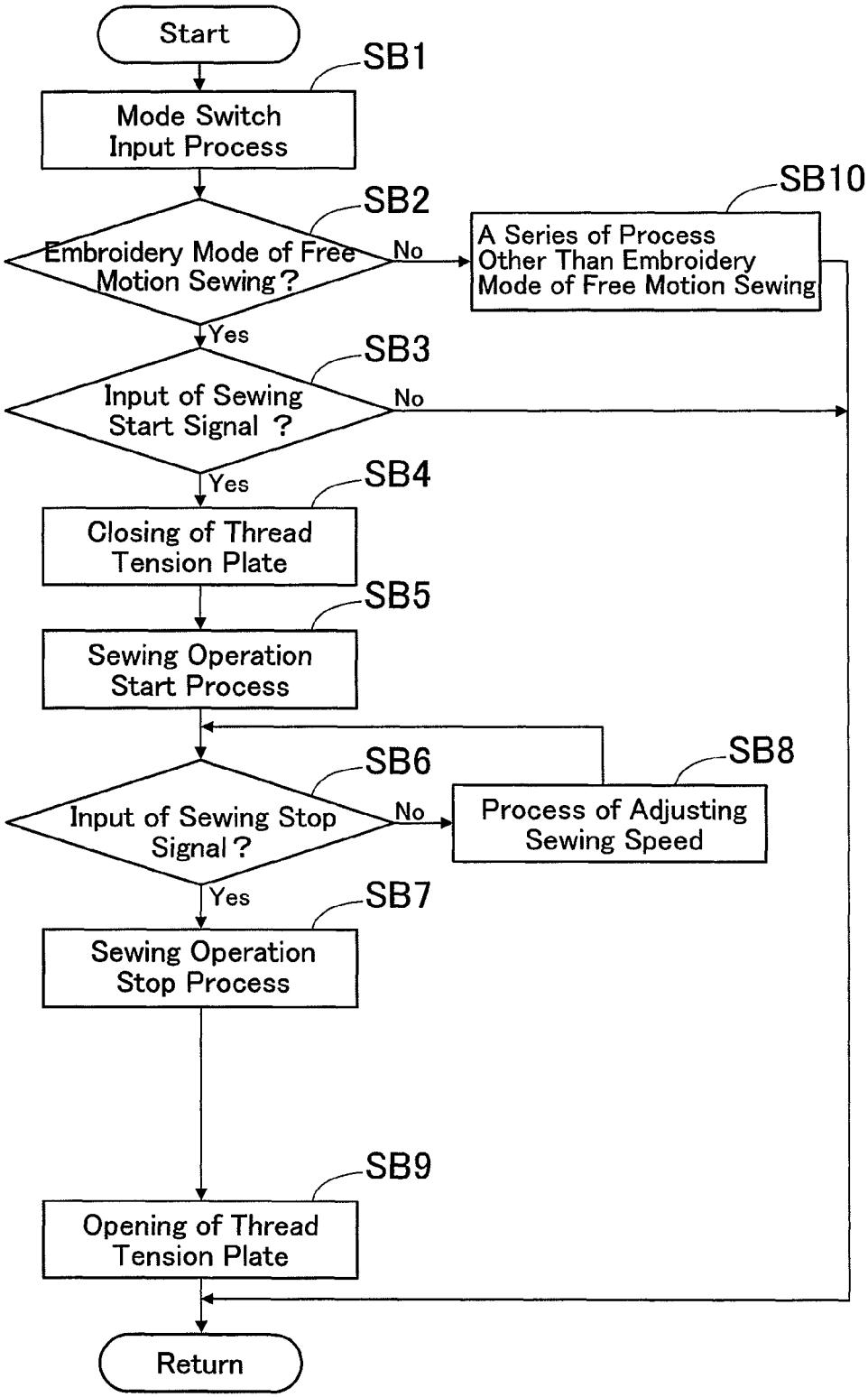
FIG. 10 is a flow chart showing a control of the sewing machine according to the second embodiment.

FIGS. 8 to 10 show a second embodiment. The present embodiment generally has the same construction and operational effects as the first embodiment. FIG. 9 shows a thread tension adjusting mechanism 81 which provides tension to an upper thread supplied to the needle 12. As shown in FIG. 9, the upper thread tension adjusting mechanism 81 is mounted in the machine frame 52 of the sewing machine main body 1 and includes a motor 82 formed of a stepping motor, a pinion 83 provided on a motor shaft of the motor 82, a drive arm 84X having a geared rack 84*c* being in engagement with the pinion 83 which is capable of swinging about a pivot shaft 84 in a direction of an arrow W, a rod 85 whose end 85*a* is in engagement with the drive arm 84*x*, a moving arm 86 which is connected to the other end 85*c* of the rod 85 and which is capable of swinging about an pivot shaft 86*m* in directions of arrows rocked in arrow directions E1 and E2, a thread tension disc 89 having a first dish 87 and a second dish 88, a spring 90 urging the first dish 87 towards the second dish 88 to close the thread tension disc 89, a pressing position sensor 91 outputting a signal detecting a vertical motion of a pressing rod 90 to the micon 30, and a thread tension knob 92 (FIG. 4) which adjusts a spring force of the spring 90 so as to adjust the tension of the upper thread.

When the motor 82 rotates in one direction, the rod 85 is moved in the direction of the arrow F1 by the pinion 83 and the drive arm 84*x*. When the motor 82 rotates in the other direction, the rod 85 is moved in the direction of the arrow F2 by the pinion 83 and the drive arm 84*x*. At this state, when the rod 85 is moved in the direction of the arrow F1, the moving arm 86 is moved in the direction of the arrow E1 to urge an end 87*a* of the first dish 87. Then, the other end 87*c* of the first dish 87 is separated from the second dish 88, thereby releasing the thread tension disc 89, which looses the tension of the upper thread. When the rod 85 is moved in the direction of the arrow F2, the moving arm 86 is moved in the direction of arrow E2, thereby reducing the force applied to the end 87*a* of the first dish 87. Then, the first dish 87 comes into close contact with the second dish 88 by means of the force of the spring 90, thereby closing the thread tension disc 89 to provide the tension to the upper thread.

The micon 30 (control unit) outputs an instruction to provide a tension to the upper thread to the motor 82 of the thread tension adjusting mechanism 81 during the sewing operation, and also outputs an instruction to loosen the tension of the upper thread to the motor 82 of the thread tension adjusting mechanism 81 when the sewing operation is stopped. While the sewing operation is at rest, the tension of the upper thread is loosened, which makes it possible to move the fabric easily for positioning the stitched portion thereof, thereby facilitating the changing a needle position easily. The upper thread tension adjusting mechanism 81 is controlled by the micon 30.

FIG. 10 is a flowchart showing a control process by which follows a sewing operation of the sewing machine 100. This control process is repeatedly performed by the micon 30 while the power supply of the sewing machine 100 remains on and is stopped immediately when the power supply is turned off. As shown in FIG. 10, in step SB1, the micon 30 performs a mode switch input processing which recognizes the mode selected by the changing-over switch 8 which serves as a switching element. Here, the micon 30 outputs, to the display lamps 7*a*1, 7*b*1, and 7*c*1, a control signal allowing display of a number or mode name corresponding to the selected mode.

In step SB2, the micon 30 determines whether or not the mode selected by the changing-over switch 8 is an embroidery mode of free motion sewing. In the present embodiment, three patterns of the free motion sewing mode including left baseline mode, central baseline mode and right baseline mode, and 17 sewing pattern modes other than the free motion sewing mode are pre-stored in the memory 30*m* of the micon 30. If an embroidery mode of free motion sewing has been selected (YES in step SB2), the micon 30 proceeds, next, to step SB3. If the mode other than the free motion sewing mode has been selected (NO in step SB2), the micon 30 proceeds to step SB10 as will be described later. In step SB3, the micon 30 determines whether or not a sewing start signal from the foot controller 20 or start switch 6 has been inputted. For example, when the micon 30 determines whether or not a sewing start signal from the foot controller 20 has been inputted, the micon 30 determines whether or not a voltage value at a position between the moving contact P and the terminal P2 of the wiper 24*b* of the foot controller 20 has been inputted to the micon 30. If the sewing start signal has been inputted (YES in step SB3), the process proceeds to step SB4. If the sewing start signal has not been inputed (NO in step SB3), the process returns.

In step SB4, the micon 30 outputs instructions for the motor 82 of the thread tension adjusting mechanism 81 equipped in the sewing machine main body 1 to close the thread tension disc 89. Thus, a tension is provided to the upper thread which is supplied to the needle 12. Next, in step SB5, the micon 30 outputs a signal, for executing a sewing operation start process, to the for-main-shaft motor 59 and the swing amount adjusting motor 71. Here, the micon 30 determines the revolution speed (*2 of Table 1) of the for-main-shaft motor 59 based on an input signal from the main body variable resistor 10, determines the amount (*2 of Table 1) of revolution of the motor 71 for adjusting the swing amount of the needle bar swing mechanism 70 based on a depression signal from the foot controller 20, and outputs the determined signals to the for-main-shat motor 59 and the swing amount adjusting motor 71. The micon 30 determines whether or not a sewing stop signal from the foot controller 20 or the start switch 6 has been inputted during the sewing operation (step SB6). For example, when determining whether or not the sewing stop signal from the foot controller 20 has been inputted, the micon 30 determines whether or not a voltage value has been inputted when the moving contact P of the wiper 24*b* of the foot controller 20 comes off the resistor body 24*a*. If the sewing stop signal has been inputted (YES in step SB6), the process proceeds to step SB7. In step SB7, the micon 30 outputs the sewing stop signal to the for-main-shaft motor 59 and the swing amount adjusting motor 71.

Here, for terminating the sewing operation, it is desired for the micon 30, instead of abrupt turning off the for-main-shaft motor 59 and the swing amount adjusting motor 71, to output a sewing operation amount of each of the for-main-shaft motor 59 and the swing amount adjusting motor 71 for gradual termination. Next, the micon 30 operates the thread tension adjusting mechanism 81 and outputs a signal for the thread tension disc 89 to open (step SB9). Thereby, the tension of the upper thread can be loosened which is supplied to the needle 12. Since the tension of the upper thread is loosened, in case of continuation of the sewing under the embroidering mode as the free motion sewing, the user is allowed to move the fabric at will in both the lateral and lengthwise directions along the upper surface 2*a* of the bed portion 2, thereby changing the needle position of the fabric freely.

Incidentally, in case of the free motion sewing, there are many discrete sewn portions, which needs frequent changing of the position of the needle 12 on the fabric in wide range. Even in this case, immediately when the user releases temporally the depression of the foot controller 20 to stop outputting the sewing stop signal, the tension of the upper thread is relaxed. Thus, even through an at-will large extent movement of the fabric is made along the upper surface 2*a* of the bed portion 2, the needle 12 is prevented from being damaged and the upper thread is prevented from being cut off. In such a way, in the free motion sewing, the upper thread is loosened after the signal for stopping the for-main-shaft motor 59 is outputted to the micon 30. Meanwhile, in a case where the sewing stop signal is not inputted (NO in step SB6), in order to continue the embroidery mode (free motion sewing mode), the micon 30 proceeds to step SB8 from step SB6. In step SB8, the micon 30 determines the sewing speed using the main body slide variable resistor 10 and adjusts the swing movement of the needle 12 in X direction based on the input signal from the foot controller 20.

In step SB10, the micon 30 performs the mode other than the free motion sewing. In this case, the sewing operation is basically similar to that of the free motion sewing but is different therefrom in the following points. That is, while in the mode other than the free motion sewing, when the sewing stop signal is outputted, though the micon 30 stops the sewing operation by stopping the for-main-shaft motor 59 and the swing amount adjusting motor, no process is executed to open the upper thread tension disc to remain the upper thread tension disc remain closed. Thereby, in the mode other than the free motion sewing, even though the sewing operation has been stopped, providing the tension of the upper thread supplied to the needle 12 remains unchanged.

In the mode other than the free motion sewing, unlike the free motion sewing, the micon 30 provides continually a tension to the thread being supplied to the needle 12. Thereby, the upper thread is prevented from being relaxed eased, and the sewing operation can be in continual good order. That is, in the mode other than the free motion sewing, unlike the free motion sewing, there is no need to move the needle position of the needle 12 frequently and in wide range. Instead, in many cases, the sewing operation is interrupted to change the feeding direction of the fabric before the subsequent sewing operation begins. For this reason, in the mode other than the free motion sewing, the continual provision of the tension to the upper thread restricts the upper thread to loose, thereby continuing the sewing operation in smooth.

Embodiment 3

Figure 11:
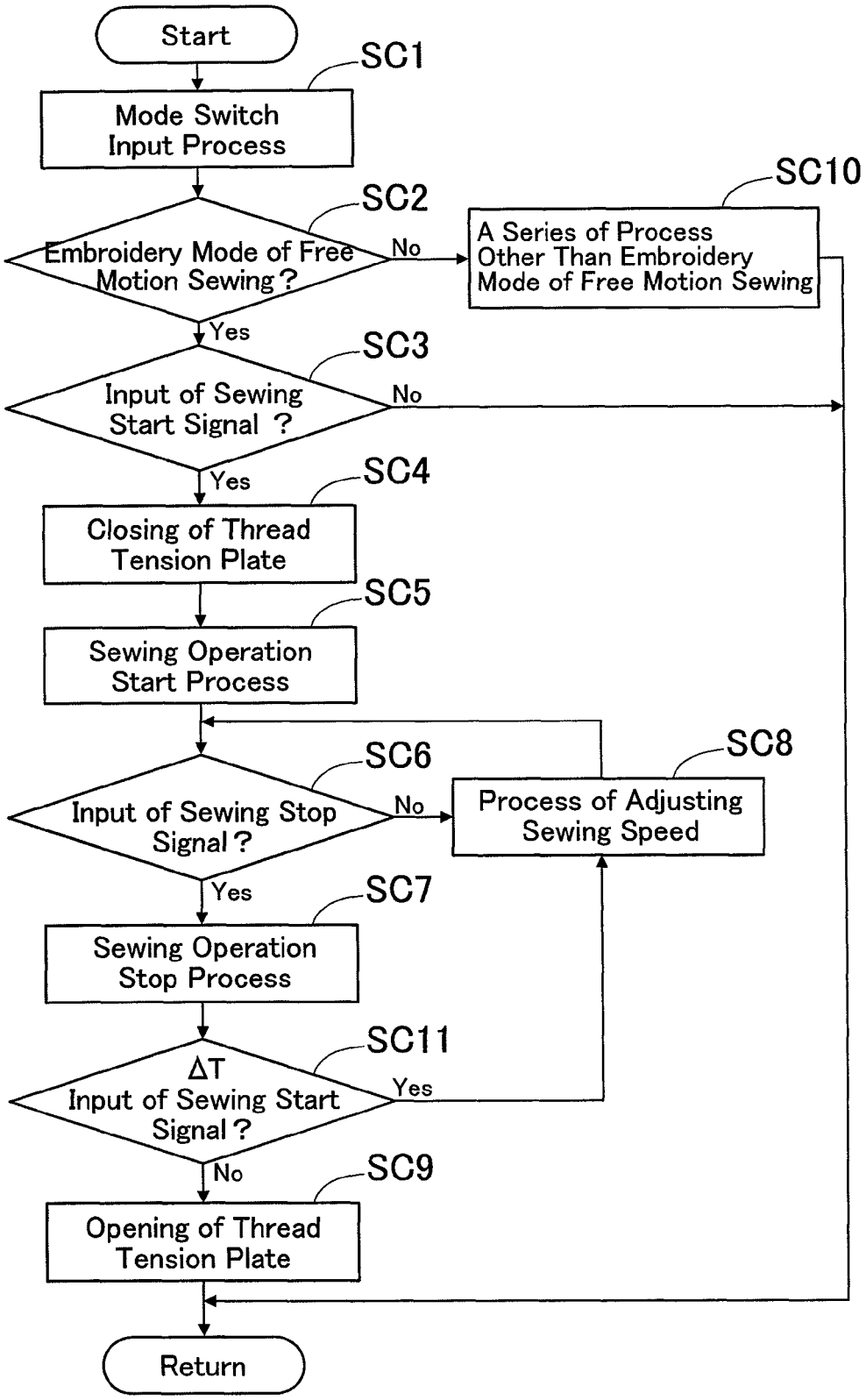
FIG. 11 is a flow chart showing a control of a sewing machine according to a third embodiment.

FIG. 11 shows a third embodiment. The present embodiment is a configuration for not loosening the upper thread immediately when the signal for stopping the for-main-shaft motor 59 is outputted to the micon 3 built in the sewing machine 100, but for loosening the upper thread by opening the thread tension disc 89 after elapse of a time duration ΔT measured from the time when the signal for stopping the for-main-shaft motor 59 is outputted. Examples of ΔT include a range between e.g. 0.2 and 3.0 seconds, a range between 0.5 and 2.0 seconds, and a preferable range between 1.0 and 1.5 seconds.

Next, an operation of the present embodiment will be described with reference to FIG. 11. FIG. 11 is a flowchart showing a control process involved in a sewing operation of the sewing machine 100. This control process is repeatedly performed by the micon 30 while the power source of the sewing machine 100 is being turned on. The following items are for differentiating from the flowchart shown in FIG. 10. When the free motion sewing mode such as embroidery mode has been selected, a sewing stop signal is inputted to the micon 30 by the foot controller 20 so as to stop the for-main-shaft shaft motor 59 (step SC7). Thereafter, the control proceeds to step SC11. In step SC11, the micon 30 waits for the time duration (ΔT) from the time when the sewing stop signal is inputted to the micon 30, and during the waiting determines whether or not the sewing start signal from the foot controller 20 is inputted to the micon 30. If the sewing start signal is inputted within the time duration ΔT (YES in step SC11), the control goes to step SC8 for adjusting the sewing speed. If the sewing start signal is not inputted within the time duration ΔT (NO in step SC11), the tension disc 89 is opened, thereby loosening the tension of the upper thread supplied to the needle 12 (step SC9).

Embodiment 4

Figure 12:
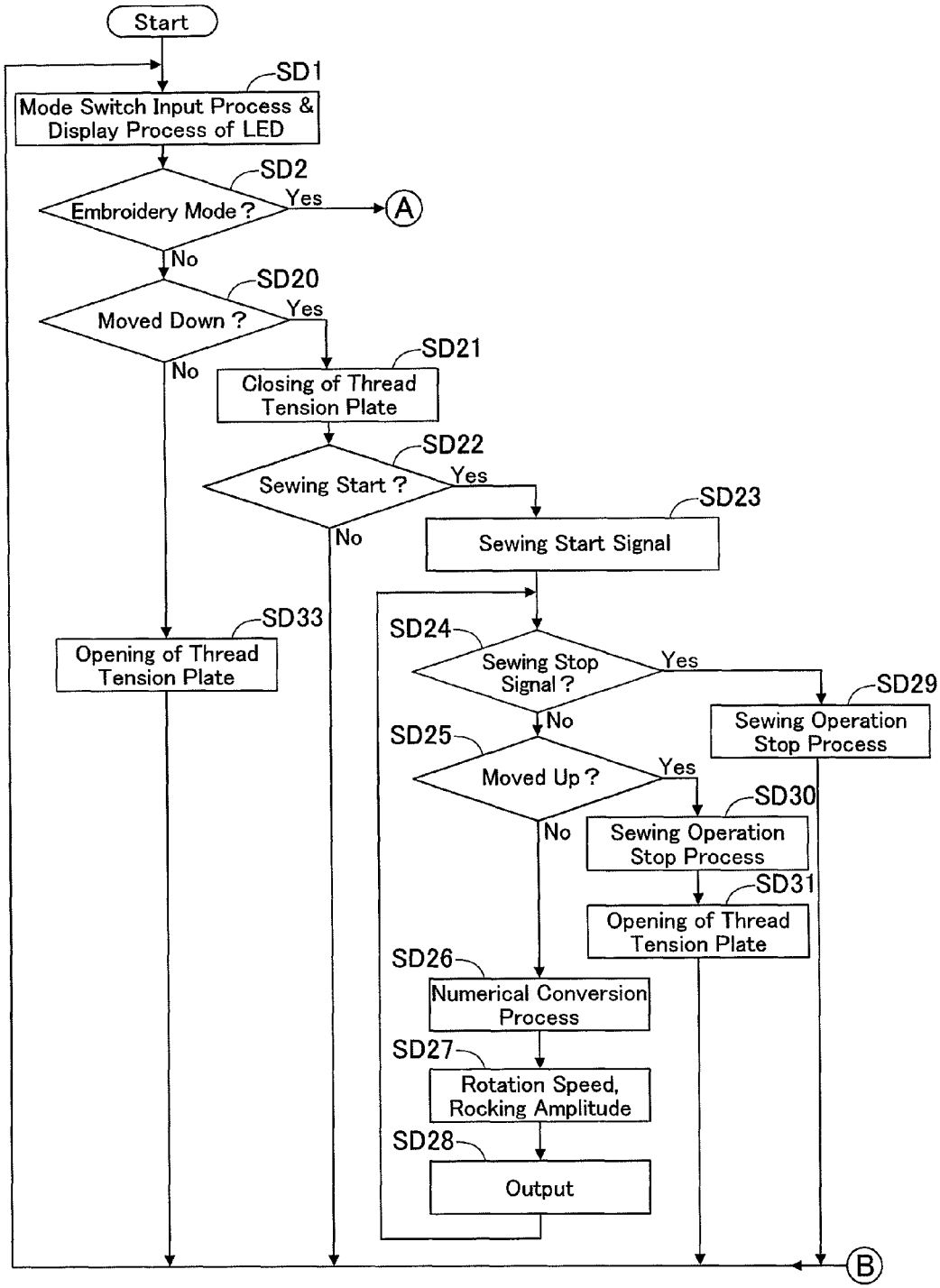
FIG. 12 is a flow chart showing a control of a sewing machine according to a fourth embodiment of the invention.
Figure 13:
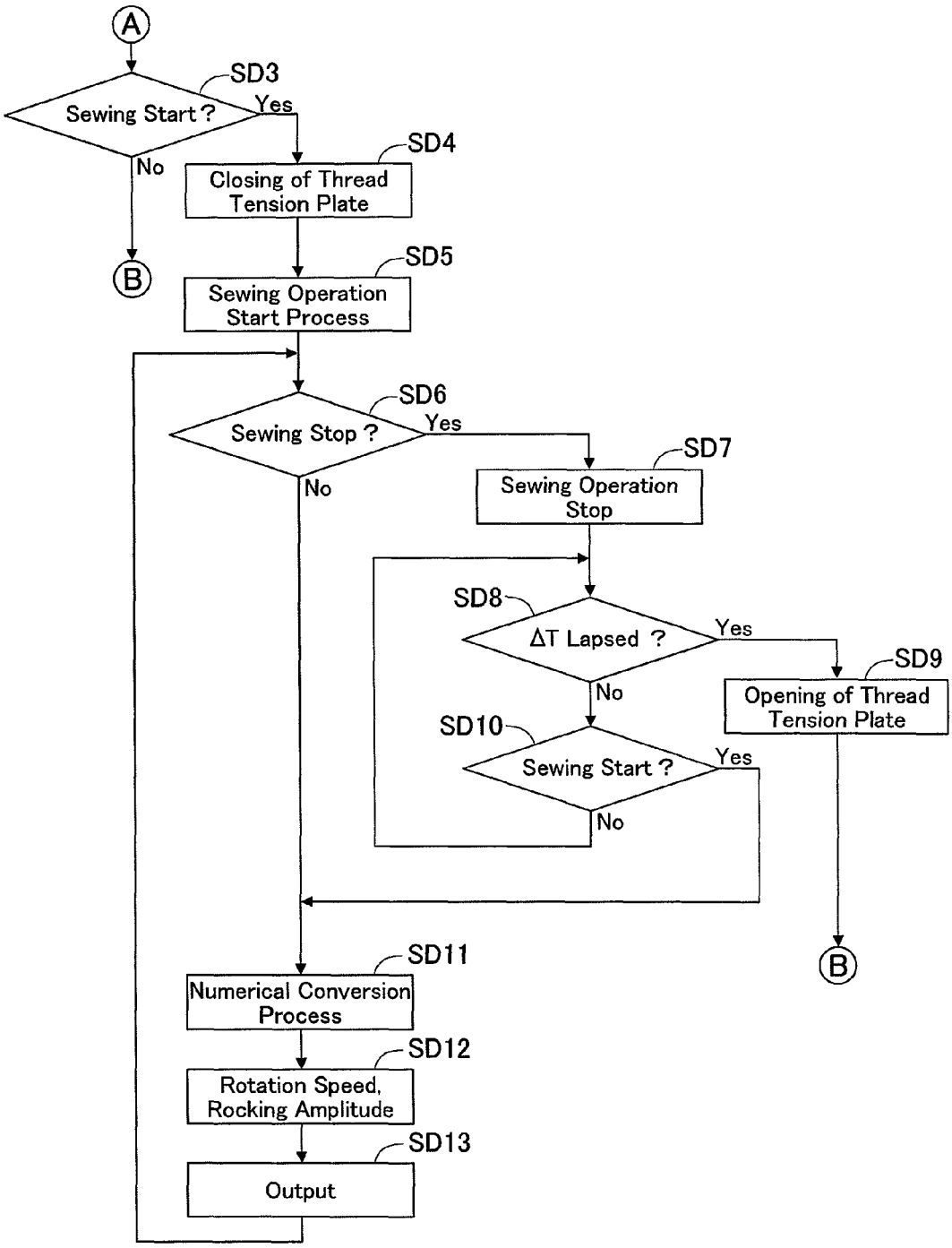
FIG. 13 is a flow chart showing a control of the sewing machine according to a fourth embodiment of the invention.
Figure 14:
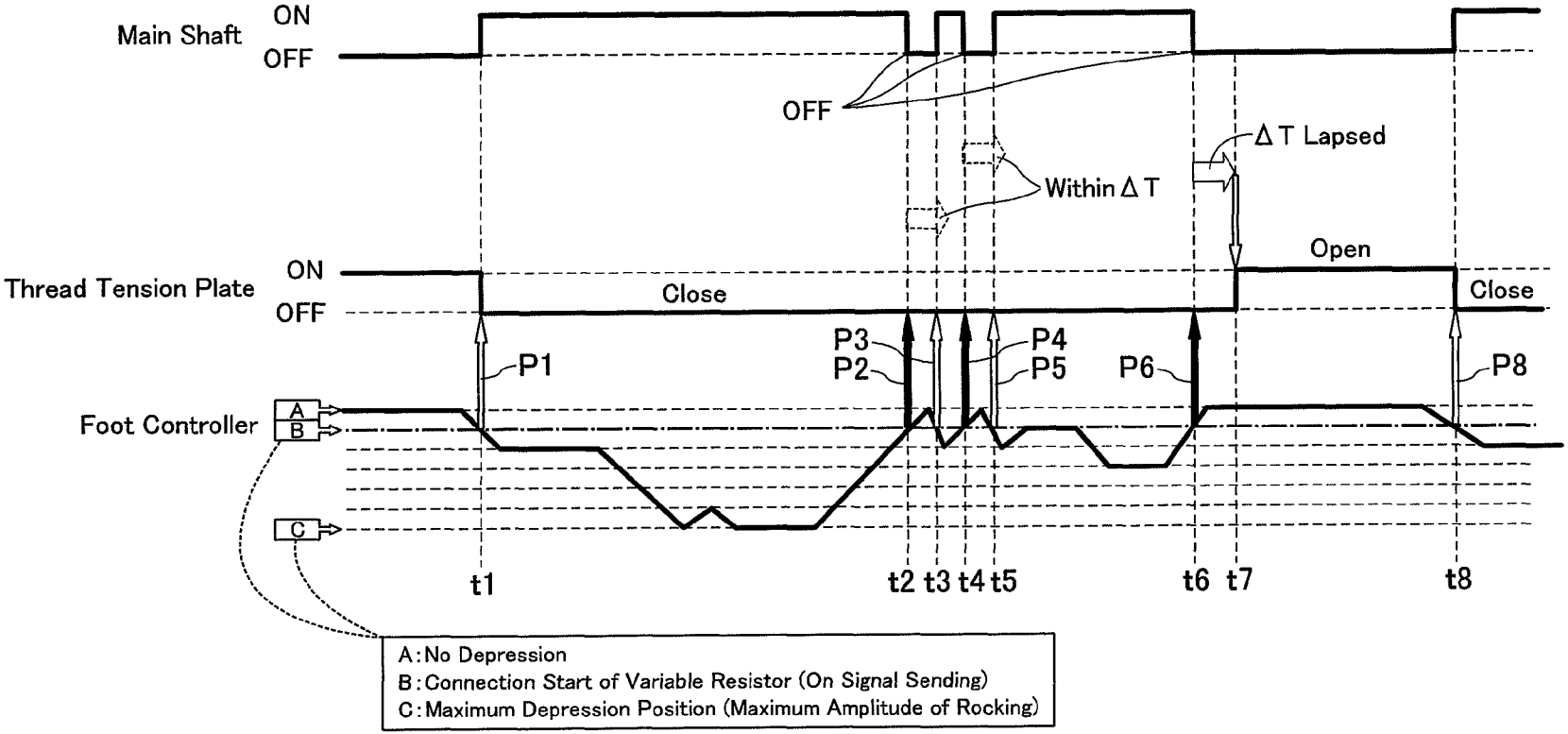
FIG. 14 is a timing chart showing a control of the sewing machine according to the fourth embodiment.

FIGS. 12 to 14 show a fourth embodiment. The present embodiment generally has the same construction and operational effects as those of the first to third embodiments. Hereinafter, differentiating items will be mainly described. During the free motion sewing, there may be of a possibility that despite of an intension to stop sewing the user temporally withdraws his/her leg from the pedal 21 by mistake. In this case, the resulting separation of the moving contact P of the wiper 24*b* from the resistor body 24*a* may cause a fear of stopping the for-main-shaft motor 59 which results outputting the sewing operation stopping signal. Even in this case, so long as the user has an intension of continuation of sewing operation, the user again depresses the pedal 21 of the foot controller 20.

In this case, unless the time duration ΔT elapses after the outputting the signal for stopping the for-main-shaft 59, the tension of the upper thread supplied to the needle 12 remains unchanged and therefore is not loosened, thereby restricting a relax of the upper thread. Thus, the user's quick re-depression of the foot controller 20 will make the sewing motion continual, thereby improving the convenience of the sewing operation. In this case, the micon 30 controls a time when the control signal for loosening the tension of the upper thread is outputted to the motor 82 of the upper thread tension adjusting mechanism 81. In the free motion sewing, for example, in a case where the foot controller 20 stops the sewing motion, re-depressing the foot pedal 20 by the user within the time ΔT will make it possible to ensuring the continuation of the sewing motion, while no re-depression of the foot pedal 20 is made within the time duration ΔT, the micon 30 outputs the control signal for loosening the tension of the upper thread to the motor 82 of the upper thread tension adjusting mechanism 81.

FIGS. 12 and 13 show flowcharts for executions of the micon 30. However, the flowcharts is not limited to these illustrations. When the start switch 6 is turned off, the control is stopped. In step SD1, the micon 30 reads the state of the main body switch S which the user manipulates and outputs a signal corresponding to the state to the display portion D for indicating the contents of the manipulation. That is, when the user manipulates the pattern number display & selection switch 7*a*, the display lamp 7*a*1 is turned on. At the same time, the current pattern number displayed on the 7-segment LEDs 9. When the user manipulates the feeding amount display & selection switch 7*b*, the display lamp 7*b*1 is turned on. At the same time, the feeding amount of the feed dog 15 (FIG. 3) is displayed on the 7-segment LEDs 9. When the user manipulates the swing amount display & selection switch 7*c*, the display lamp 7*c*1 is turned on. At the same time, the swing amount of the needle 12 is displayed on the 7-segment LEDs 9.

Next, the micon 30 determines whether or not the mode of Satin stitch embroidery (the free motion sewing) has been selected (step SD2). In this case, the micon 30 reads the operation condition of the changing-over switch 8. If the embroidery mode has been selected, the micon 30 proceeds to step SD3 to determine whether or not the sewing start signal is outputted. In detail, when the foot controller 20 is depressed, the sewing start signal is outputted. If the sewing start signal is outputted (YES in step SD3), a signal for providing the tension on the upper thread by closing the tension disc 89 is outputted the thread tension adjusting mechanism 81 (step SD4) and a process of initiating the sewing operation (step SD5). Specifically, a numerical conversion process of the foot controller 20 is performed based on the depression amount of the pedal 21. That is, an analog value of the depressed amount of the pedal 21 which corresponds to the adjusting amount of the swing movement of the needle 12 is inputted to the micon 30 for A/D conversion. Furthermore, based on the resulting A/D converted value and a data value (*2) of Table 1 pre-stored in the memory 30*m* of the micon 30, the micon 30 determines the swing amount of each of the needle bar 11 and the needle 12 in the lateral direction (X direction). Meanwhile, the main shaft rpm is determined based on an indicated value of the slide knob 10*a* of the main body slide variable resistor 10 and data pre-stored in the memory 30*m* of the micon 30 (*2 of Table 1).

Furthermore, the micon 30 determines whether or not the sewing stop signal is outputted (Step SD6) and if outputted performs the sewing operation stop procedure to stop the rotation of the for-main-shaft motor 59 (step SD7). Next, the micon 30 determines whether or not the time duration ΔT has been elapsed after the time point when the sewing stop signal is outputted (step SD8). Upon satisfactions of both conditions, one being negative as to the elapse of time duration ΔT after the time point when the sewing stop signal is outputted (NO in step SD8), the other being negative as to the issue of the sewing starting signal (NO in step SD10), the control returns to step SD8 to continue measuring the time duration ΔT. In contrast, upon satisfactions of both conditions, one being negative as to the elapse of time duration ΔT after the time point when the sewing stop signal is outputted (NO in step SD8), the other being positive as to the issue of the sewing starting signal (YES in step SD10), the control goes to step SD11 to perform the sewing operation procedure.

In detail, the micon 30 performs the numerical conversion process of the foot controller 20 based on the depression amount of the pedal 21 of the foot controller 20 (step SD 11). That is, the analog value of the depressed amount of the pedal 21 is inputted to the micon 30 for being brought into A/D conversion. Furthermore, based on the resulting A/D conversion value and the data value (*2) of Table 1 pre-stored in the memory 30*m* of the micon 30, the micon 30 determines the swing amount of the needle 12 in the lateral direction (X direction) (step SD12). Furthermore, the micon 30 determines the main shaft rpm based on an indicated value of the adjusting knob 10*a* of the main body slide variable resistor 10 and the data (*2 of Table 1) pre-stored in the memory 30*m* of the micon 30 (step SD12). Furthermore, the micon 30 outputs the resulting signals to the for-main-shaft motor 59 and the swing amount adjusting motor 71 (step SD13) and returns to step SD6 to allow the free motion sewing to continue. Thereby, the main shaft 53 is driven to rotate, causing the needle bar 11 and the needle 12 to swing in the direction of the arrow X during vertical movements thereof. If both conditions are satisfied, one being positive as to the elapse of time duration ΔT after the time point when the sewing stop signal is outputted (YES in step SD8), the other being positive as to the issue of the sewing starting signal (YES in step SD10), the micon 30 orders the upper thread tension adjusting mechanism 81 to open the tension disc 89 for relaxing the tension of the upper thread. Under such a condition, the user can move the fabric at will in an Y direction.

On the other hand, if both conditions are satisfied, one being negative as to the elapse of time duration ΔT after the time point when the sewing stop signal is outputted (No in step SD8), the other being positive as to the issue of the sewing starting signal (Yes in step SD10), the control goes from Step SD10 to step SD11 to continue the sewing operation process.

In other words, if the determination in step SD6 indicates that the sewing stop signal is not outputted (No in step SD6), the sewing operation process is continued by executing s of steps SD11, SD12, and SD13. In this case, as described before, the main shaft 53 is driven to rotate, causing the needle 11 and the needle 12 to swing in the direction of the arrow X during vertical movements thereof.

However, in a case where embroidery mode is not selected (NO in step SD2), it is determined whether or not the presser foot 90 is lowered (step SD20). This is detected by the presser foot position sensor 91. If the presser foot 13 is not lowered (NO in step SD20), in order to stop the sewing, the micon 30 issues an order for loosening the tension of the upper thread to the motor 82 of the upper thread tension adjusting mechanism 81 to open the tension disc 89 (step SD33). If the presser foot 13 is lowered (YES in step SD20), in order to perform the sewing, the micon 30 issues an order for providing the tension to the upper thread to the motor 82 of the thread tension adjusting mechanism 81 (step SD21), and determines whether or not the sewing start signal is outputted (step SD22). The sewing start signal is outputted to the micon 30 by the depression of the foot controller 20 or manipulating the start switch 6 as described before. If the sewing start signal is outputted (YES in step SD22), the micon 30 performs the sewing operation start process (step SD23).

Specifically, an analog value of the depression amount of the pedal 21 of the foot controller 20 is inputted to the micon 30 and is brought into A/D conversion. Furthermore, the micon 30 determines the main shaft rpm based on the resulting A/D converted value and the data (*1) of Table 1 pre-stored in the memory 30*m* of the micon 30. Meanwhile, the swing amount of the needle 12 is determined based on the indicated value of the main body switch S and the data (*1 of Table 1) pre-stored in the memory 30*m* of the micon 30. If the sewing stop signal is outputted (YES in step SD24), the sewing operation stop process is executed (step SD29) to stop the for-main-shaft switch motor 59.

When nevertheless the sewing stop signal is not outputted (NO in step SD24), a condition that the presser foot 90 is raised is satisfied (YES in step SD25), the sewing is inhibited, which causes the micon 30 to performs the sewing operation stop process (step SD30) for loosening the tension of the upper thread by opening the tension disc 89 (step SD31). If conditions are satisfied, one being negative as to the output of the sewing stop signal (NO in step SD24), the other being negative as to the presser foot 13 being raised (NO in step SD25), the sewing is permitted, which causes the micon 30 to perform the sewing operation start process. Specifically, the micon 30 performs a numerical conversion process of the foot controller 20 based on the depression amount of the pedal 21 of the foot controller 20 (step SD26). That is, an analog value of the depression amount of the pedal 21 is inputted to the micon 30 and is brought into A/D conversion (step SD26). Furthermore, the micon 30 determines the main shaft rpm based on the resulting A/D converted value and the data value (*1 of Table 1) of Table 1 pre-stored in the memory 30*m* of the micon 30 (step SD27). Furthermore, the micon 30 determines the swing amount of the needle 12 in the lateral direction based on the indicated value of the main body switch S and the data (*1 of Table 1) pre-stored in the memory 30*m* of the micon 30 (step SD28). Furthermore, the micon 30 outputs the resulting signals to the for-main-shaft motor 59 and the swing amount adjusting motor 71 (step SD28) and returns to step SD24.

FIG. 14 shows a timing chart of the control of the free motion sewing (embroidery mode). This chart shows the on-off signal of the for-main-shaft 59, the open and close signal of the tension disc 89, and the depression amount (manipulation amount) of the foot controller 20. At time point t1 when the foot controller 20 is moved to the position B from the position A, if the sewing start signal is outputted, the signal for closing the tension disc 89, thereby providing the tension on the upper thread. Furthermore, at the time t1, the signal for turning the for-main-shaft motor 59 on is outputted, causing the main shaft 53 to rotate. Between the time point t1 and the time point t2, even though the depression amount of the foot controller 20 varies, so long as the foot controller remains on state, the tension disc 89 is kept closed to provide tension on the upper thread and simultaneously the for-main-shaft motor 59 turns on to rotate the main shaft 53.

In a case of temporal release of the user's leg from the foot controller 20 by mistake which is contrary to the user's intention to continue the sewing, sometimes the sewing stop signals P2 and P4 may be outputted at the time point t2 and a time point t4, respectively. In this case, it is assumed that the foot controller 20 is depressed again by the user's leg and at time points t3 and t5 the sewing starting signals P3 and P5, respectively, are outputted from the foot controller 20 to the micon 30. Even in this case, within an elapse of the time duration ΔT after the time point t2 when the sewing stop signal P2 is outputted or within an elapse of the time duration ΔT after the time point t4 when the sewing stop signal P4, the tension disc 89 remains closed to keep the tension of the upper thread. Indeed, at time points t2 and t4, based on the sewing stopping signals P2 and P4 are outputted, respectively, for turning off the for-main-shaft motor 59. However, at the time points t3 and t5, the sewing start signals P3 and P5, respectively, are outputted again from the foot controller 20 to the micon 30, causing the main shaft 53 to rotate again. The rotation of the main shaft 53 brings the needle bar 11 into the vertical movement, thereby performing the sewing operation.

At a time point t6, the user's leg releases the foot controller 20 according to the user's intention of stopping the sewing. Then, a sewing stop signal P6 is outputted at the time point t6 from the foot controller 20 to the micon 30. In this case, at the time point t6 when the sewing stop signal P6 is outputted, the stop signal is outputted for stopping the for-main-shaft motor 59. Here, at a time point t7 after an elapse of the time duration ΔT from the time point t6, the signal is outputted from the micon 30 for opening the tension disc 89, thereby loosening the tension of the upper thread. At a time point t8, if the sewing start signal P8 is outputted to the micon 30 from the foot controller 20 which results from a depression of the foot controller 20, the signal is outputted for causing the tension disc 89 in open state to close, thereby providing the tension on the upper thread and simultaneously outputting the signal to turn on the for-main-shaft motor 59 for rotating the main shaft 53. The rotation of the main shaft 53 causes the needle bar 11 in the vertical direction, thereby performing the sewing operation.

As described before, even when the sewing stopping signal is outputted which results from the temporal release of the user's leg from the foot controller 20 contrary to the user's intension to continue the sewing, unless the time duration ΔT elapses from the time point when the sewing stop signal is outputted from the micon 30, the tension disc 89 remains closed or the upper thread is kept at a condition of tension provided. This enable the user to resume the sewing by a prompt depression of the foot controller 20.

Embodiment 5

Figure 15:
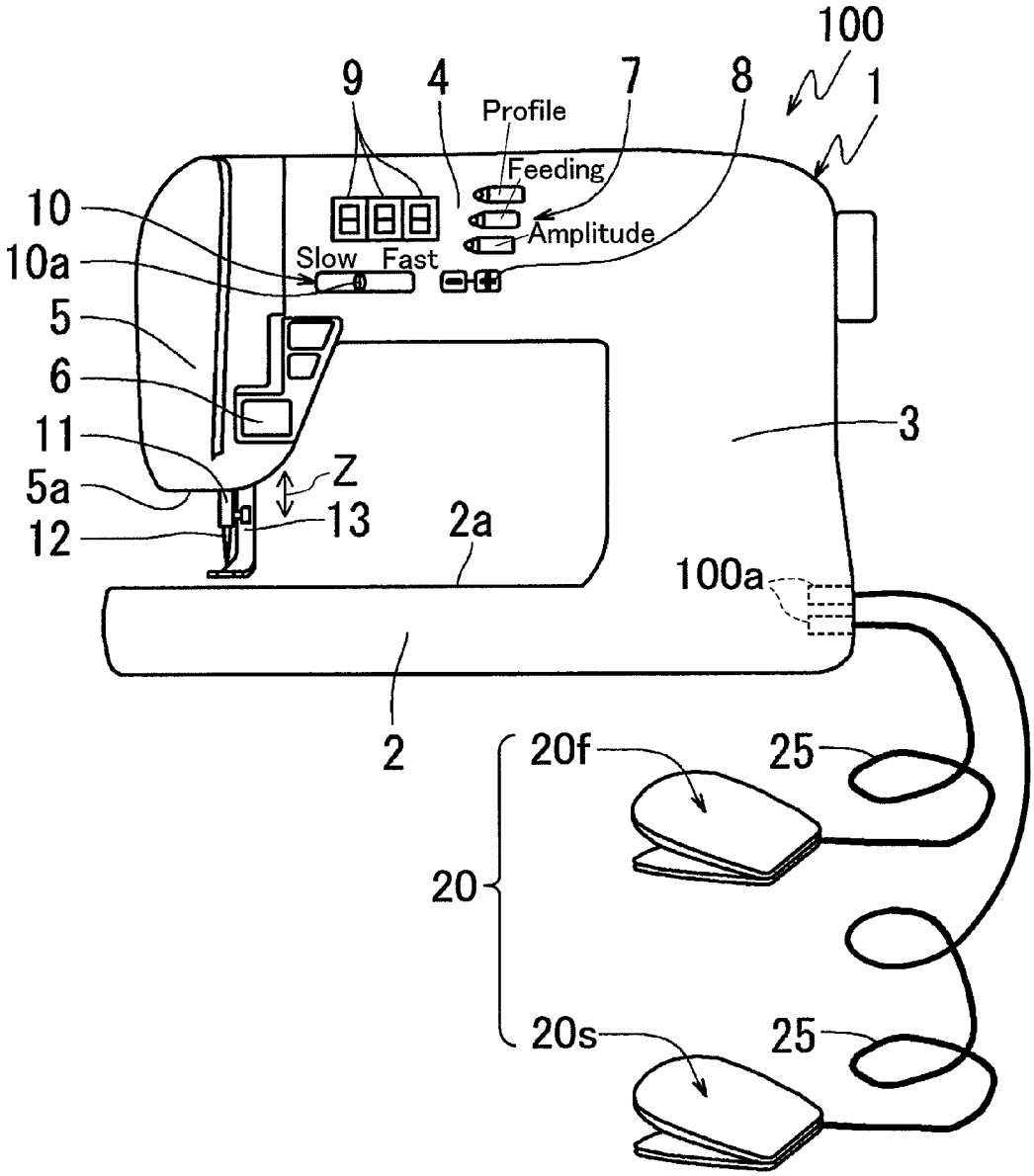
FIG. 15 is a front view of a sewing machine of according to a fifth embodiment.

FIG. 15 shows a fifth embodiment. The present embodiment generally has the same construction and operational effects as those of the first to fourth embodiments. Hereinafter, differentiated portions will be mainly described. The foot controller 20 has a first foot controller part 20*f* (a first foot manipulation part) and a second foot controller part 20*s* (a second foot manipulation part) which are separated from each other and from which depression signals are respectively inputted to the micon 30. Here, the first foot controller part 20*f* is expected to be depressed by either one of user's left and right legs, while the second foot controller part 20*s* is expected to be depressed by the other of the user's left and right legs.

In the free motion sewing mode, the micon 30 determines the swing amounts of the needle bar 11 and the needle 12 based on the depression amount (*2 of Table 1) of the first foot controller part 20*f*. In addition, in the free motion sewing mode, the micon 30 determines the main shaft rpm or the sewing speed based on the depression amount (*1 of Table 1) of the second foot controller part 20*s*.

Meanwhile, in the mode other than the free motion sewing, any either one of the first foot controller part 20*f* and second foot controller part 20*s* may be used. It is to be noted that the present embodiment is not limited to the above construction, but may be configured such that while not shown in the drawings, even though the foot controller 20 is a single structure, it may include first and second foot manipulation parts which input a depression signal to the micon 30.

Embodiment 6

Figure 16:
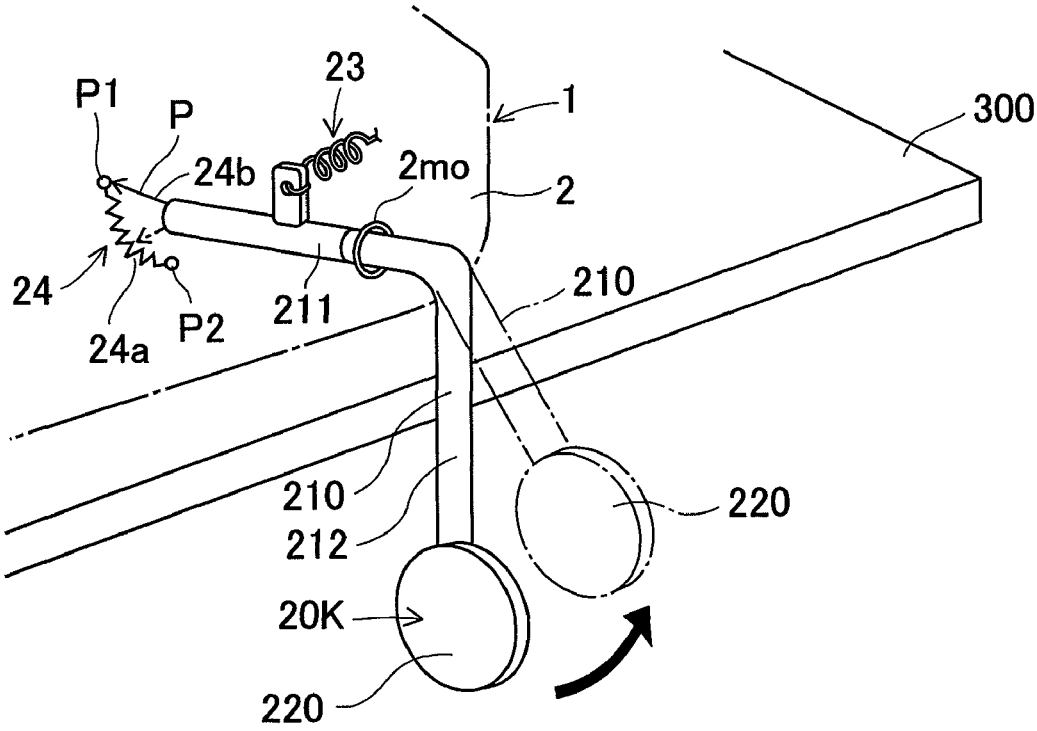
FIG. 16 is a front view of a main portion of a sewing machine according to a sixth embodiment.

FIG. 16 shows a concept of a sixth embodiment. The present embodiment generally has the same construction and operational effects as those of the first to fifth embodiments. Hereinafter, differentiating points will mainly be described. Similar codes are utilized in designating the corresponding similar portions. As shown in FIG. 16, a foot controller 20*k* is of the type to be operated by the left and right sides at a user's knee and/or thigh. The foot controller 20*k* includes a substantial L-shaped arm 210 rotatably mounted through a throughhole 2*mo* formed in the front surface of the bed part 2 by means of bearing (not shown), a manipulation part 220 provided on top of the arm 210 so as to be manipulated to the left and right sides at the user's knee and/or thigh, a return spring 23 returning the position of the arm 210 to its original position, a variable resistor 24 provided in the bed part 2 and having a resistor body 24*a*, and a wiper 24*b* moving according to the resistor body 24*a* of the variable resistor 24 in association with arm 210. When the manipulation part 220 is manipulated to the left and right sides at the user's knee and/or thigh, the arm 210 is moved in the same direction in correspondence with the manipulation, and the wiper 24*b* is moved correspondingly. A dynamic contact P of the wiper 24*b* is moved on the resistor body 24*a* based on the left and right motions of the arm 210 and the manipulation part 220, and outputs a signal to the micon 30. The arm 210 preferably consists of a first arm part 211 provided in the bad part 2 such that it has the wiper 24*b* and a second arm part 212 exposed to the outside of the bed part 2. The second arm part 212 is preferably detachably mounted to the first arm part 211. The first and second arm parts 211 and 212 may be formed into a single piece.

(Others) The present invention is not limited to the embodiments explained and described in the drawings, but may be properly modified and implemented within the scope to which the gist of the invention pertains.

The invention claimed is:

1. A sewing machine comprising:

a needle bar capable of supporting a needle and capable of vertical reciprocal movement;

a needle bar vertical moving mechanism bringing the needle bar into the vertical reciprocal movement;

a needle bar swing mechanism causing the needle bar to swing in a lateral direction relative to a longitudinal direction along which a feed dog operates for straight stitch; and a control portion controlling operations of the needle bar vertical moving mechanism and the needle bar swing mechanism for adjusting a swing amount of the needle bar which is brought into a swing movement in the lateral direction by the needle bar swing mechanism during a free motion sewing mode; and an upper thread tension adjusting mechanism for providing a tension on an upper thread which extends to the needle from an upper thread supply source, wherein during the free motion sewing mode in a case where a signal for stopping the free motion sewing is outputted, the control portion causes the upper thread tension adjusting mechanism to provide the tension on the upper thread unless a time durationΔT elapses after the outputting of the signal for stopping the free motion sewing and causes the upper thread tension adjusting mechanism to loosen the tension on the upper thread if the time durationΔT elapses after the outputting of the signal for stopping the free motion sewing.

2. The sewing machine according to claim 1, further comprising a foot controller which a user can operate by leg, wherein during the free motion sewing mode the control portion adjusts the swing amount of the needle bar in the lateral direction in response to an operation of the foot controller.

3. The sewing machine according to claim 2, wherein during the free motion sewing mode the control portion makes the needle bar vertical moving mechanism active and inactive when the foot controller is operated and is not operated, respectively.

4. The sewing machine according to claim 2, wherein during the free motion sewing mode the control portion adjusts the swing amount of the needle bar in the lateral direction in response to the operation of the foot controller, while during a sewing mode other than the free motion sewing mode the control portion adjusts a sewing speed at which the needle bar moves in the vertical direction.

5. The sewing machine according to claim 4, further comprising a switching element, the switching element being for the foot controller to switch between adjusting the swing amount during the free motion sewing mode and adjusting the sewing speed at which the needle bar moves in the vertical direction during the sewing mode other than the free motion sewing mode.

6. The sewing machine according to claim 1 further comprising an adjusting switch for adjusting the sewing speed at which the needle bar moves in the vertical direction during the free motion sewing mode.

7. The sewing machine according to claim 1 further comprising an upper thread tension adjusting mechanism for providing a tension on an upper thread which extends to the needle, wherein the control portion issues an order to the upper thread tension adjusting mechanism for providing the tension on the upper thread during sewing operation, while during out of sewing operation, the control portion issues an order to the upper thread tension adjusting mechanism for loosening the tension of the upper thread.

8. The sewing machine according to claim 1, wherein the foot controller includes a first operating part and a second operating part, wherein the control portion adjusts, based on an operation of the first operation part, the swing amount of the needle bar which is brought into swing movement in the lateral direction by the needle bar swing mechanism and adjusts, based on an operation of the second operation part, the sewing speed at which the needle bar moves in the vertical direction.

9. The sewing machine according to claim 2, wherein that the foot controller is of operation type of the user's foot depression or the user's knee and/or thigh manipulation.

* * * * *